US009504109B2

(12) United States Patent
Moon et al.

(10) Patent No.: US 9,504,109 B2
(45) Date of Patent: Nov. 22, 2016

(54) BALANCED AC DIRECT DRIVER LIGHTING SYSTEM WITH A VALLEY FILL CIRCUIT AND A LIGHT BALANCER

(71) Applicant: Altoran Chips & Systems, Santa Clara, CA (US)

(72) Inventors: Kyeongtae Moon, San Ramon, CA (US); Jae Hong Jeong, Saratoga, CA (US)

(73) Assignee: Altoran Chips & Systems, Santa Clara, CA (US)

( * ) Notice: Subject to any disclaimer, the term of this patent is extended or adjusted under 35 U.S.C. 154(b) by 0 days.

(21) Appl. No.: 14/706,676

(22) Filed: May 7, 2015

(65) Prior Publication Data

US 2016/0174314 A1 Jun. 16, 2016

Related U.S. Application Data

(63) Continuation-in-part of application No. 14/566,710, filed on Dec. 11, 2014.

(51) Int. Cl.
*H05B 37/02* (2006.01)
*H05B 33/08* (2006.01)

(52) U.S. Cl.
CPC ..... *H05B 33/0824* (2013.01); *H05B 33/0809* (2013.01); *H05B 33/0845* (2013.01)

(58) Field of Classification Search
CPC ..... H05B 33/089; H05B 33/0815
USPC ..... 315/185 R, 291, 294, 299, 308
See application file for complete search history.

(56) References Cited

U.S. PATENT DOCUMENTS

2011/0227504 A1* 9/2011 Kim ..... H05B 33/0818 315/294
2014/0145628 A1* 5/2014 Wang ..... H05B 33/083 315/187
2014/0145632 A1* 5/2014 Wey ..... H05B 33/0815 315/193

* cited by examiner

*Primary Examiner* — Thuy Vinh Tran

(57) ABSTRACT

An AC direct driver lighting system is disclosed. According to one embodiment, the AC direct driver lighting system includes a plurality of LED groups serially connected to an AC power source, and an AC driver comprising a plurality of current sinks. Each of the plurality of current sinks is connected between a respective LED group of the plurality of LED groups and a ground. The AC direct driver lighting system further includes a valley fill circuit coupled to a target LED group of the plurality of LED groups. The valley fill circuit charges from the AC power source and supplies electrical power to the target LED group via a current path established between the AC power source and the ground via at least one of the plurality of current sinks.

17 Claims, 18 Drawing Sheets

2950

| Current Sink | State | | | | | | | | |
|---|---|---|---|---|---|---|---|---|---|
| LED1 | SB | Reg. | OFF | OFF | OFF | OFF | OFF | Reg. | SB |
| LED2 | SB | SB | Reg. | OFF | OFF | OFF | Reg. | SB | SB |
| LED3 | SB | SB | SB | Reg. | OFF | Reg. | SB | SB | SB |
| LED4 | SB | SB | SB | SB | Reg. | SB | SB | SB | SB |

BALANCED AC DIRECT DRIVER LIGHTING SYSTEM WITH A VALLEY FILL CIRCUIT AND A LIGHT BALANCER

CROSS REFERENCES

This application is continuation-in-part of U.S. application Ser. No. 14/566,710, filed on Dec. 11, 2014, which claims the benefit of and priority to U.S. Provisional Application No. 61/917,332 filed on Dec. 17, 2013 and entitled "Apparatus for Flicker-free, Balanced-Light AC Direct Step Driver Lighting System with Valley Fill and Light Balancer," the disclosures of which are hereby incorporated by reference in their entirety.

FIELD

The present disclosure relates in general to the field of AC lighting systems, and in particular, to a balanced AC direct driver lighting system with a valley fill circuit and a light balancer.

BACKGROUND

An alternating current (AC) lighting system refers to a system that directly drives a lighting load such as light emitting diode (LED), organic light emitting diode (OLED), or other light emitting devices or components using rectified AC line voltage from an AC power source. AC lighting systems eliminate the need of a power conversion unit from an AC power source to a direct current (DC) power source. Due to their simple design and less components, AC lighting systems provide a low-cost solution for residential or commercial applications receiving power directly from an AC power source.

Despite their cost advantages, implementation of advanced features such as dimming control, mood lights, and color variations in a conventional AC lighting system poses technical difficulties because the fluctuating AC line voltage. Furthermore, LED segments in a conventional AC lighting system are often driven in a sequential order, therefore light emitted from each LED segment is not uniform across a light fixture. If the voltage across an LED group of an AC lighting system is not high enough to turn on the LEDs within the LED group, the corresponding LED group turns off resulting in an undesirable ripple of the AC lighting system.

SUMMARY

An AC direct driver lighting system is disclosed. According to one embodiment, the AC direct driver lighting system includes a plurality of LED groups serially connected to an AC power source, and an AC driver comprising a plurality of current sinks. Each of the plurality of current sinks is connected between a respective LED group of the plurality of LED groups and a ground. The AC direct driver lighting system further includes a valley fill circuit coupled to a target LED group of the plurality of LED groups. The valley fill circuit charges from the AC power source and supplies electrical power to the target LED group via a current path established between the AC power source and the ground via at least one of the plurality of current sinks.

The above and other preferred features, including various novel details of implementation and combination of events, will now be more particularly described with reference to the accompanying figures and pointed out in the claims. It will be understood that the particular systems and methods described herein are shown by way of illustration only and not as limitations. As will be understood by those skilled in the art, the principles and features described herein may be employed in various and numerous embodiments without departing from the scope of the present disclosure.

BRIEF DESCRIPTION OF THE DRAWINGS

The accompanying drawings, which are included as part of the present specification, illustrate the presently preferred embodiment and together with the general description given above and the detailed description of the preferred embodiment given below serve to explain and teach the principles described herein.

Figure 1:
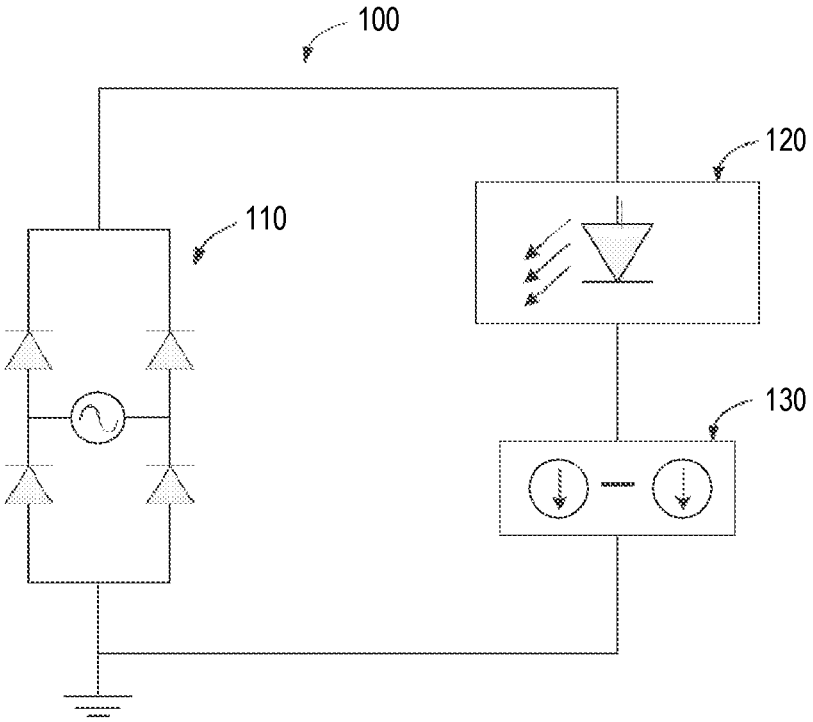
Figure 1 (Prior Art)
FIG. 1 illustrates a prior art AC direct step lighting system.

The figures are not necessarily drawn to scale and elements of similar structures or functions are generally represented by like reference numerals for illustrative purposes throughout the figures. The figures are only intended to facilitate the description of the various embodiments described herein. The figures do not describe every aspect of the teachings disclosed herein and do not limit the scope of the claims.

DETAILED DESCRIPTION

An AC direct driver lighting system is disclosed. According to one embodiment, the AC direct driver lighting system includes a plurality of LED groups serially connected to an AC power source, and an AC driver comprising a plurality of current sinks. Each of the plurality of current sinks is connected between a respective LED group of the plurality of LED groups and a ground. The AC direct driver lighting system further includes a valley fill circuit coupled to a target LED group of the plurality of LED groups. The valley fill circuit charges from the AC power source and supplies electrical power to the target LED group via a current path established between the AC power source and the ground via at least one of the plurality of current sinks.

Each of the features and teachings disclosed herein can be utilized separately or in conjunction with other features and teachings to provide a method for providing an AC light system with a control unit for controlling power of an LED. Representative examples utilizing many of these additional features and teachings, both separately and in combination, are described in further detail with reference to the attached drawings. This detailed description is merely intended to teach a person of skill in the art further details for practicing preferred aspects of the present teachings and is not intended to limit the scope of the claims. Therefore, combinations of features disclosed in the following detailed description may not be necessary to practice the teachings in the broadest sense, and are instead taught merely to describe particularly representative examples of the present teachings.

In the following description, for purposes of explanation only, specific nomenclature is set forth to provide a thorough understanding of the present invention. However, it will be apparent to one skilled in the art that these specific details are not required to practice the present invention.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

The present disclosure describes a system and method for providing uniform lighting distribution using an AC direct step driver. The present system and method has a simple structure with less electric components and achieves a balance in brightness among LED groups contained in the AC lighting system while reducing ripple.

The present system and method utilizes a valley-fill circuit in an AC lighting system. A valley-fill circuit is a type of passive power storage circuit. An AC voltage is applied is rectified to produce a rectified line voltage, for example using a bridge rectifier, the rectified line voltage is applied across the valley-fill circuit. A charging element of the valley-fill circuit (e.g., capacitor) is charged until it is charged up to approximately half of the peak line voltage. When the line voltage falls below the peak line voltage, into a "valley" phase, the voltage output across the valley-fill circuit begins to fall toward half of the peak line voltage. The charging element begins to discharge into the load at the voltage output.

FIG. 1 illustrates a prior art AC direct step lighting system. The AC lighting system 100 includes an LED driver 130 and an LED load 120. The LED driver 130 is powered by a power source 110 such as an alternative current (AC) power source including a fuse and a transient protection circuit between a live wire (AC_L) and a neutral wire (AC_N). The electrical current from the AC power source 110 is rectified by a rectifier circuit. The rectifier circuit can be any suitable rectifier circuit, such as a bridge diode rectifier, capable of rectifying the alternating power from the AC power source 110. The rectified voltage $V_{rect}$ is applied to the LED load 120. If desirable, the AC power source 110 and the rectifier circuit may be replaced by a direct current (DC) power source.

LED as used herein are a general term for many different kinds of LEDs, such as traditional LED, super-bright LED, high brightness LED, organic LED, etc. The LED driver 130 is configured to drive many different kinds of LEDs. The LED load 120 is electrically connected to the power source 110 and is in the form of a string of LEDs divided into a plurality of LED groups. However, it should be apparent to those of ordinary skill in the art that the LED load 120 may contain any number of LED groups and LED elements (or LED dies) in each LED group, and may be divided into any suitable number of groups without deviating from the scope of the present subject matter. The LED elements in each LED group may be a combination of the same or different kind, such as different color. The LED load 120 can be connected in serial, parallel, or a mixture of both. In addition, one or more resistances may be included inside each LED group.

The LED driver 130 controls the LED current that flows through the LED load 120. According to one embodiment, the LED driver 130 is a direct AC step driver ACS0804 or ACS0904 by Altoran Chips and Systems of Santa Clara, Calif. The LED driver 130 integrates a plurality of high voltage current sinks, and each high voltage current sink drives each LED group. When the rectified voltage, $V_{rect}$, reaches a reference voltage $V_f$, the LED groups in the LED load 120 turn on gradually when the corresponding current sink has a headroom. Each LED channel current sink increases up to a predefined current level for each current sink and maintains its level until the following group's current sink reaches to its headroom. At any point in a time domain, there is at least one active LED group. When the active LED group is changed from one group to the adjacent group with a change in the rectified voltage, $V_{rect}$, new active group's current gradually increases while the existing active group's current gradually decreases. The mutual compensation between LED groups achieves a smooth LED current change reduces blinking or flickering. However, light distribution across different the LED groups may not be uniform.

Figure 2:
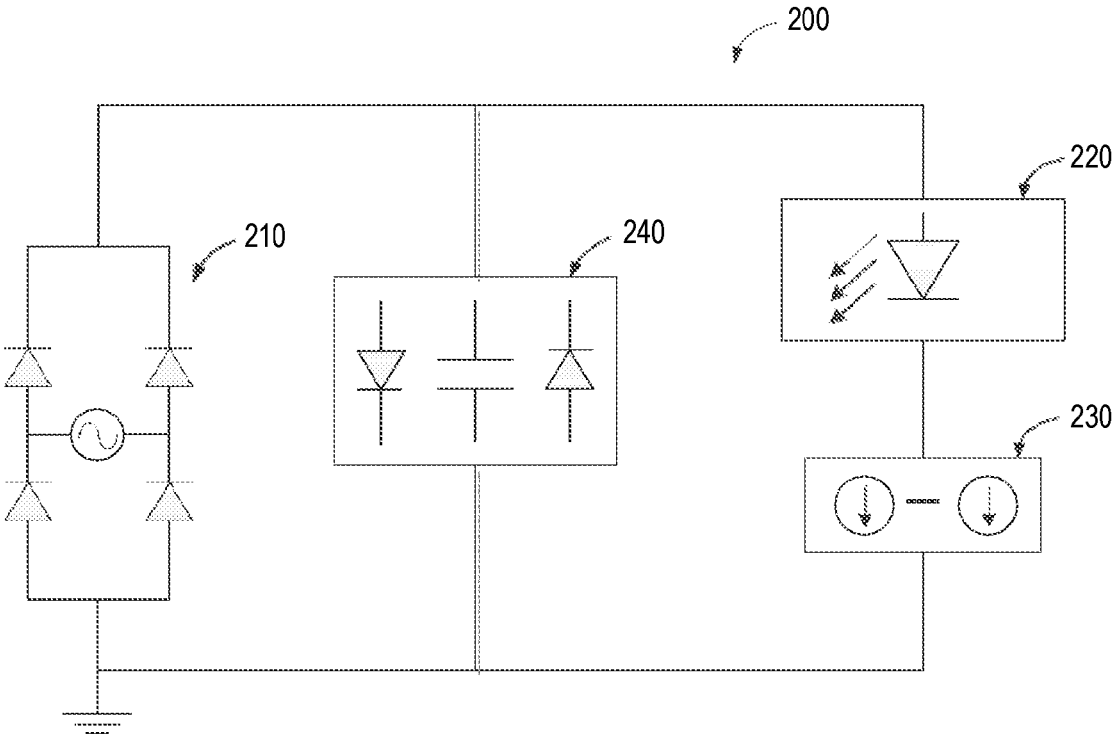
Figure 2 (Prior Art)
FIG. 2 illustrates a prior art AC direct step lighting system including a valley fill circuit.

FIG. 2 illustrates a prior art AC direct step lighting system including a valley fill circuit. The AC direct step lighting system 200 includes an LED driver 230 and is powered by the AC power source 210. The valley fill circuit 240 is disposed between the AC power source 210 and the LED load 220. The LED load 220 is driven by the LED driver 230 in a similar manner described with reference to FIG. 1. The valley fill circuit 240 includes an energy storage element (e.g., a capacitor) and a couple of diodes. The physical layout and the actual implementation of the elements contained in the valley fill circuit 240 are well known in the art, thus the representation of the valley fill circuit 240 in FIG. 2 by a container including a capacitor and two diodes should not be construed as limiting. The diodes utilize energy stored in the energy storage element to drive the LED load 220 when the input voltage from the AC power source 210 is not high enough to drive the LED load 220. The AC direct step lighting system 200 charges and discharges the energy storage element of the valley fill circuit 240 and drives the LED load 220 when necessary. Resultantly, the valley fill circuit 240 changes the current load on AC power source 210 that may impact the power factor and/or total harmonic distortion (THD) that is distortion of the relationship between the AC line power 210 and the LED current draw.

Figure 3:
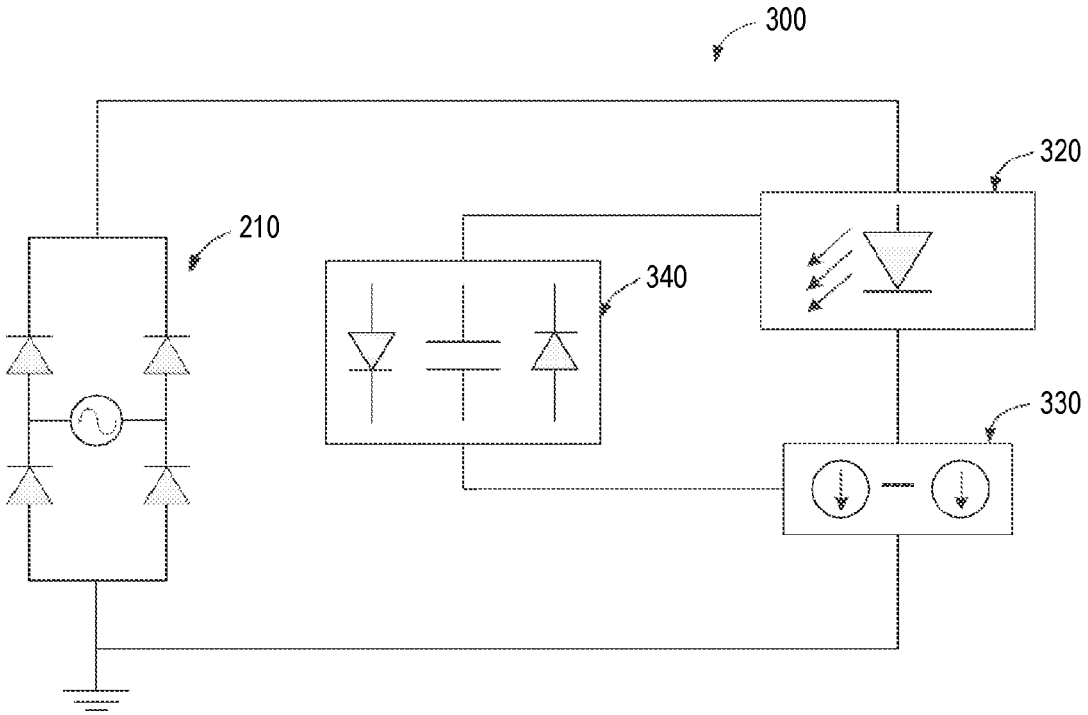
Figure 3 (Prior Art)
FIG. 3 illustrates another prior art AC direct step lighting system including a valley fill circuit.

FIG. 3 illustrates another prior art AC direct step lighting system including a valley fill circuit. The AC direct step lighting system 300 includes an LED driver 330 and is powered by the AC power source 310. The valley fill circuit 340 includes an energy storage element (e.g., a capacitor) that is controlled by a charging/discharging driver. The valley fill circuit 340 is disposed between the LED load 320 and the LED driver 330. Unlike, the AC direct step lighting system 300 of FIG. 3, the energy storage element of the valley fill circuit 340 is not directly shown to the AC power source 310, therefore the AC direct step lighting system 300 achieves a higher power factor and THD via the controlled energy storage element. However, the AC direct step lighting system 300 neither guarantees a valley fill action for each LED group nor achieves a light balance across LED groups. In addition, the valley fill circuit 340 requires a control by the LED driver 330 and changes the energy flow between the LED load 320 and the LED driver 330.

Figure 4:
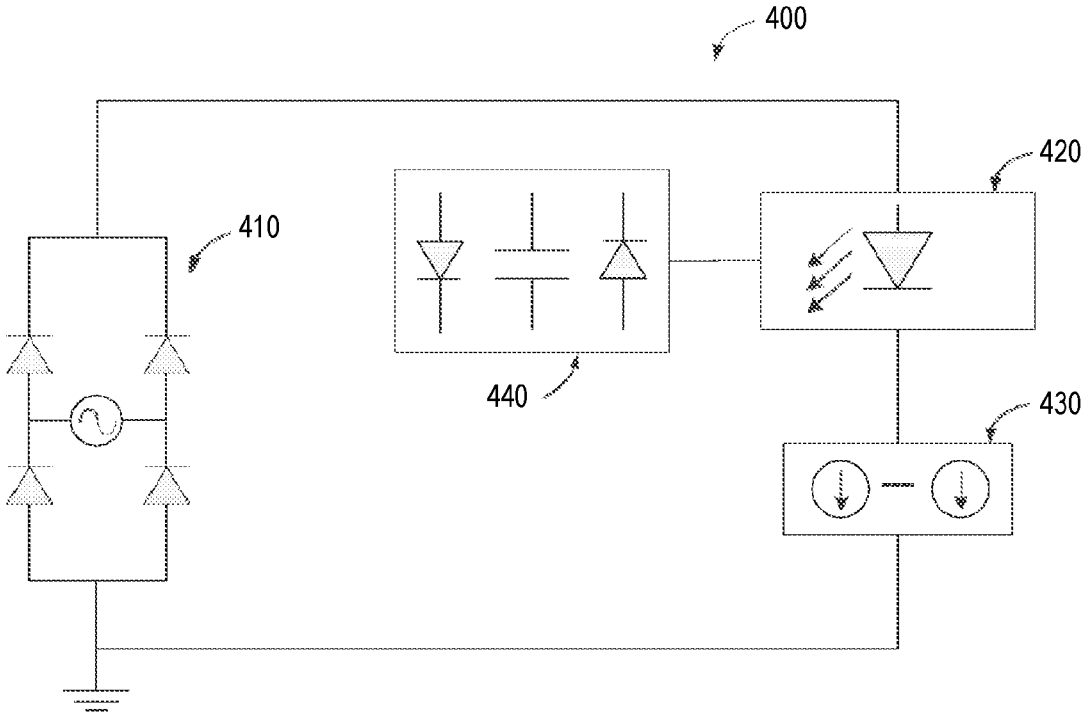
FIG. 4 illustrates an exemplary AC direct step lighting system including a valley fill circuit, according to one embodiment.

FIG. 4 illustrates an exemplary AC direct step lighting system including a valley fill circuit, according to one embodiment. The AC direct step lighting system 400 includes an LED driver 430 and is powered by the AC power source 410. The valley fill circuit 440 is directly connected to the LED load 420. The valley fill circuit 440 does not require a control from the LED driver 430 and locally provides electrical power to the LED load 420. Since the valley fill circuit 440 is not visible to the AC power source 410, it does not affect the load in the AC power line and has a minimal effect on the power factor and THD.

Figure 5:
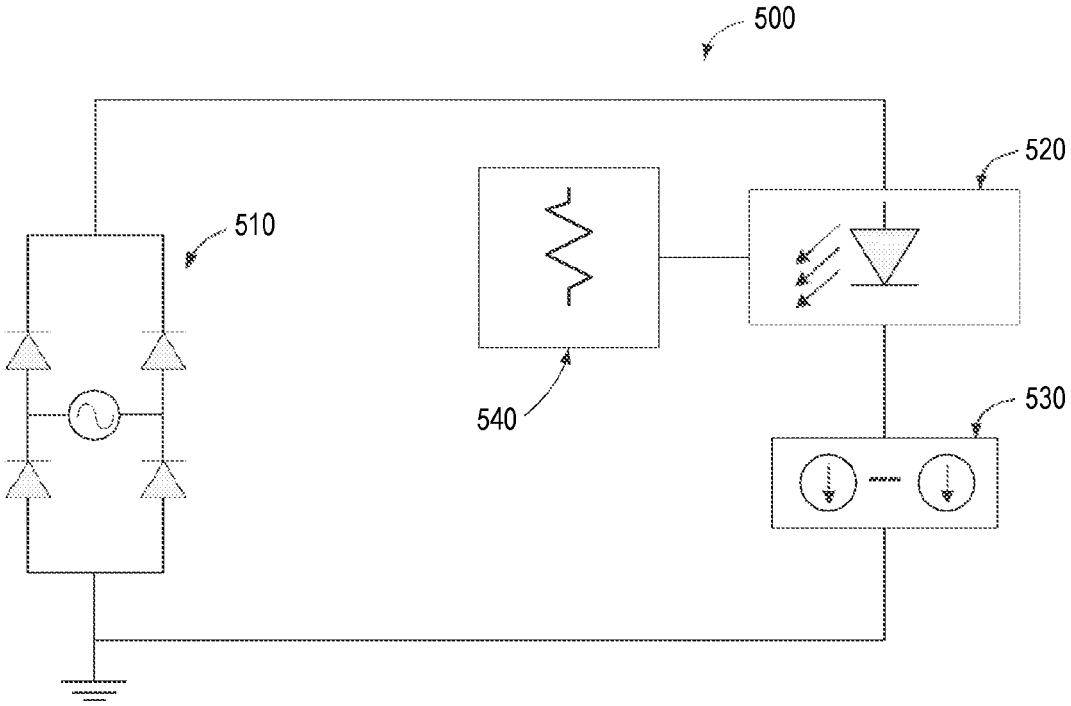
FIG. 5 illustrates an exemplary AC direct step lighting system including a light balancer circuit, according to one embodiment.

FIG. 5 illustrates an exemplary AC direct step lighting system including a light balancer circuit, according to one embodiment. The AC direct step lighting system 500 includes an LED driver 530 and is powered by the AC power source 510. The light balancer 540 (e.g., a resistor) is directly coupled to the LED load 520. The light balancer 540 in parallel with the target LED group 520 reduces the LED current, and resultantly reduces the brightness of target LED group and matches the brightness of target LED group with other LED groups in the LED load 520.

Figure 6:
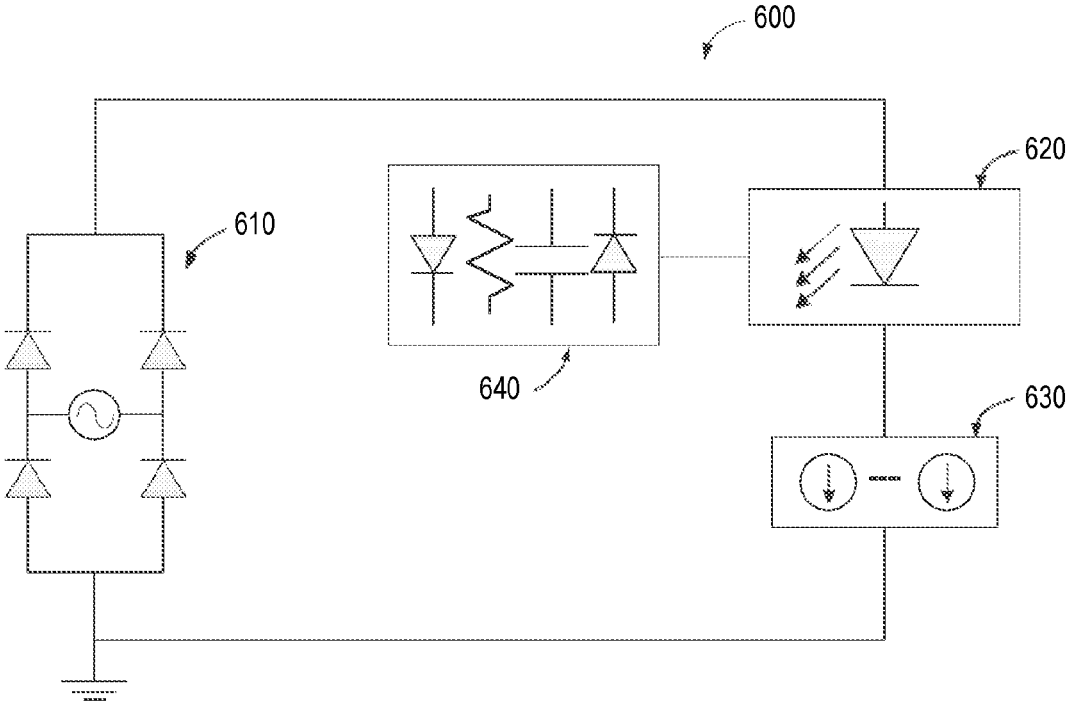
FIG. 6 illustrates an exemplary AC direct step lighting system including a valley fill circuit and a light balancer circuit, according to one embodiment.

FIG. 6 illustrates an exemplary AC direct step lighting system including a valley fill circuit and a light balancer circuit, according to one embodiment. The AC direct step lighting system 600 includes an LED driver 630 and is powered by the AC power source 610. A circuit 640 that includes both a valley fill circuit and a load balancer is connected to the LED load 620 including a plurality of LED groups. The valley fill circuit stores and provides continuous energy to a target LED group, and the light balancer reduces the target LED group's current level to match the brightness of target LED group with other LED groups contained in the LED load 620. The light balancer circuit also helps discharging energy stored in the valley fill circuit 640 when the system is disconnected from the AC power source 610 or the AC power source 610 does not have a voltage high enough to drive the LED load 620.

Figure 7:
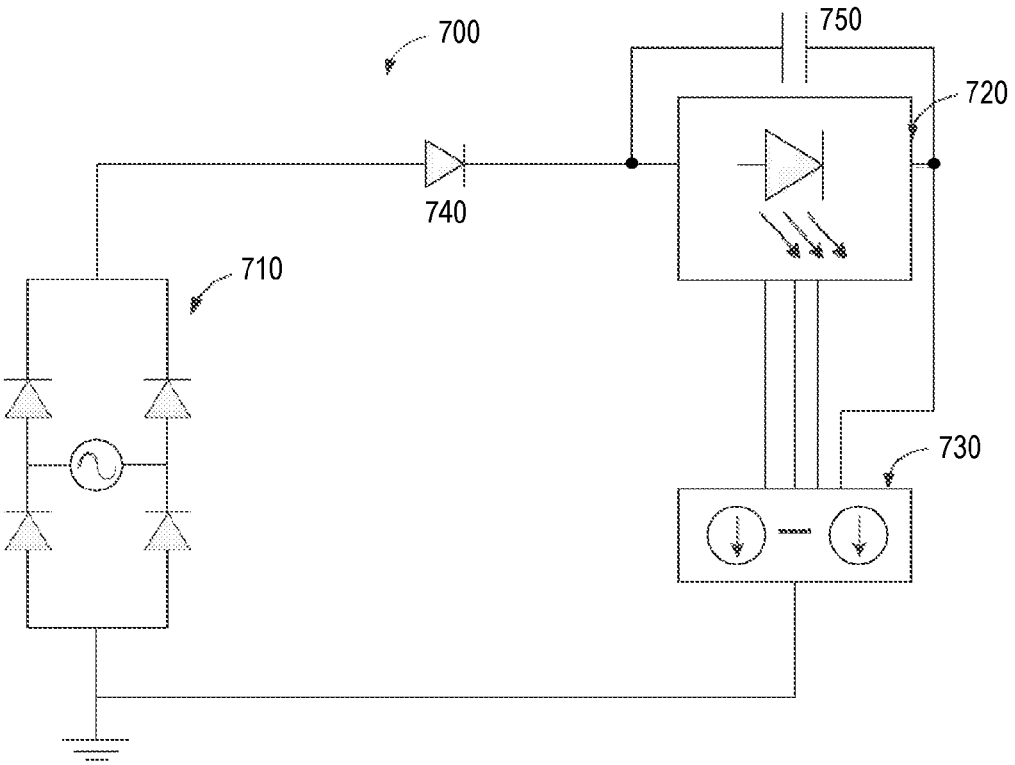
FIG. 7 illustrates an exemplary AC direct step lighting system including a valley fill circuit, according to another embodiment.

FIG. 7 illustrates an exemplary AC direct step lighting system including a valley fill circuit, according to another embodiment. The AC direct step lighting system 700 includes an LED driver 730 and is powered by the AC power source 710. The valley fill circuit has a diode 740 disposed between the rectified AC voltage source 710 and a first LED group and a capacitor 750 across the LED load 720. In this example, the LED driver 730 has 4 current sinks, therefore the LED driver 730 can drive up to four LED groups. Depending on the number of current sinks in the LED driver, different number and combination of LED groups may be driven by the LED driver 730. The diode 740 prevents the stored energy from flowing in the opposite direction and provides electrical power from the AC voltage source 710 to the LED groups contained in the LED load 720. The capacitor 750 provides energy to the LED group 720 when the system is disconnected from the AC power source 710 or the voltage level of the AC power source 710 is not high or stable enough to drive the LED load 720.

Figure 8:
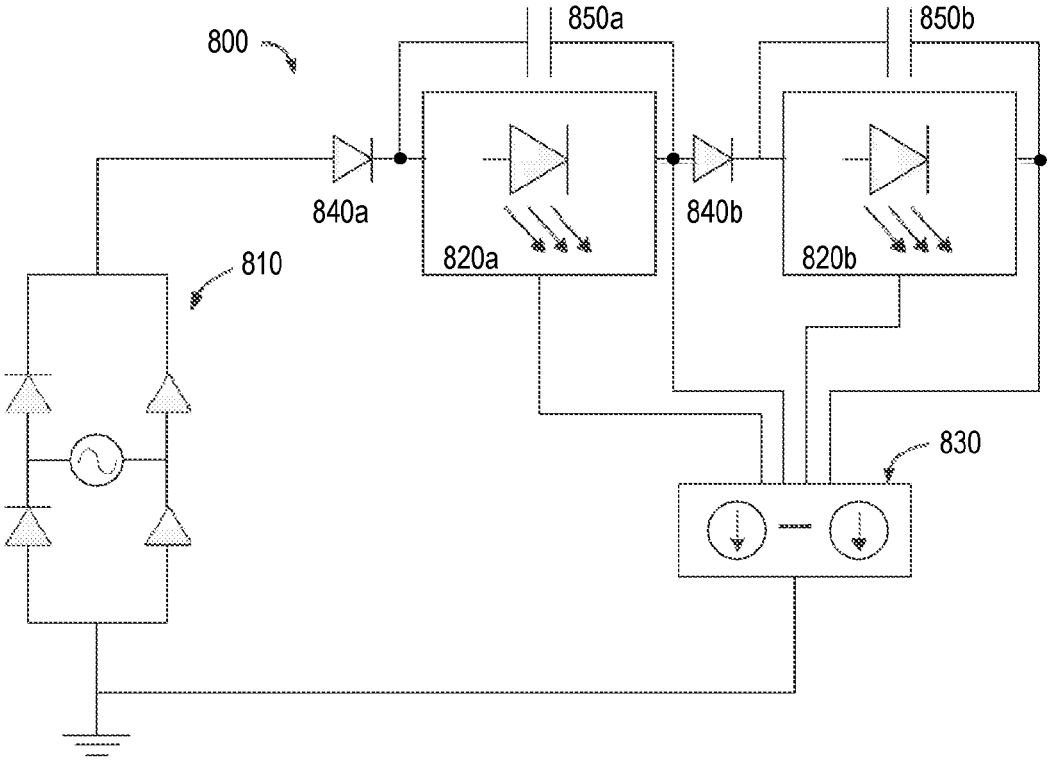
FIG. 8 illustrates an exemplary AC direct step lighting system including a valley fill circuit for each target LED group, according to one embodiment.

FIG. 8 illustrates an exemplary AC direct step lighting system including a valley fill circuit for each target LED group, according to one embodiment. The AC direct step lighting system 800 includes an LED driver 830 and the LED groups 820*a* and 820*b* powered by the LED driver 830. Each of the LED group (820*a* and 820*b*) is coupled to a corresponding valley fill circuit that includes a diode (840*a* and 840*b*) and a capacitor (850*a* and 850*b*). The LED groups 820*a* and 820*b* is a representation of any number of LED groups grouped together, in this example, two LED groups. The capacitors 850*a* and 850*b* are used to store and drive the coupled target LED groups 820*a* and 820*b*, and the diodes 840*a* and 840*b* prevent the stored energy from flowing in the opposite direction and provides the energy for corresponding target LED group. The LED groups 820*a* and 820*b* are connected in series, thus are powered in sequence.

Figure 9:
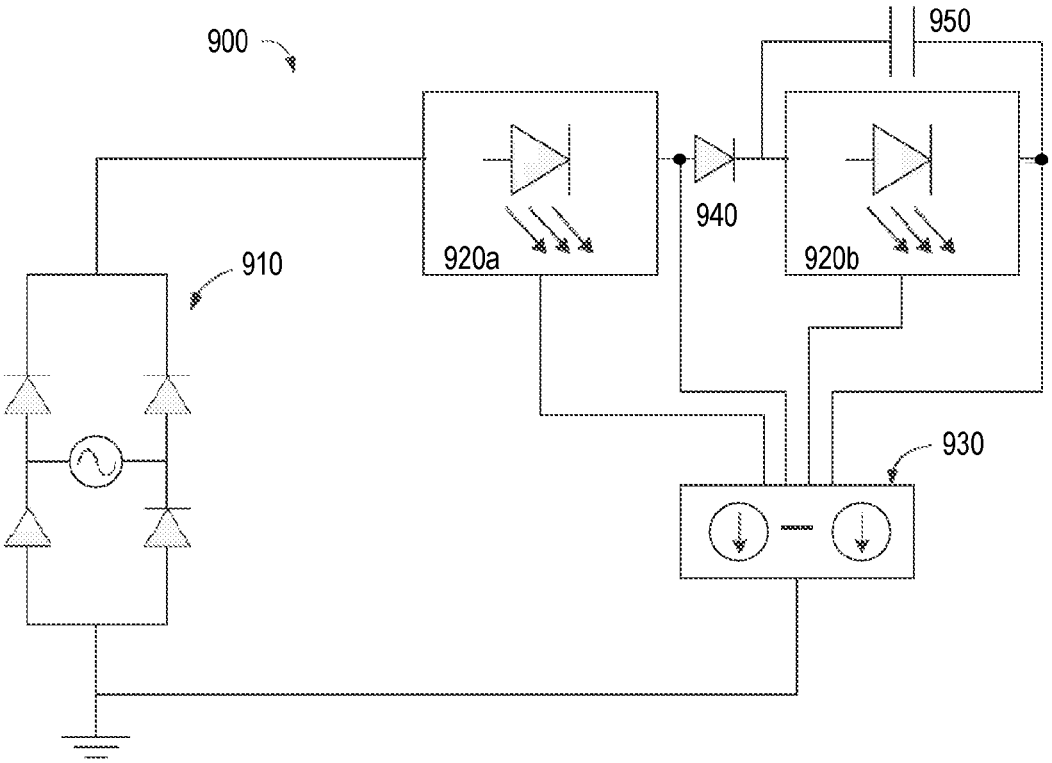
FIG. 9 illustrates an exemplary AC direct step lighting system including a valley fill circuit for each target LED group, according to another embodiment.

FIG. 9 illustrates an exemplary AC direct step lighting system including a valley fill circuit for each target LED group, according to another embodiment. The AC direct step lighting system 900 includes an LED driver 930 and the LED groups 920*a* and 920*b* powered by the LED driver 930. In this embodiment, the valley fill circuit is used on a downstream portion of the LED load, i.e., the LED group 920*b*. The AC direct step lighting system 900 reduces light fluctuation on the target LED group and minimizes voltage fluctuation shown on current sink in the LED driver 930 that drives the target LED group.

Figure 10:
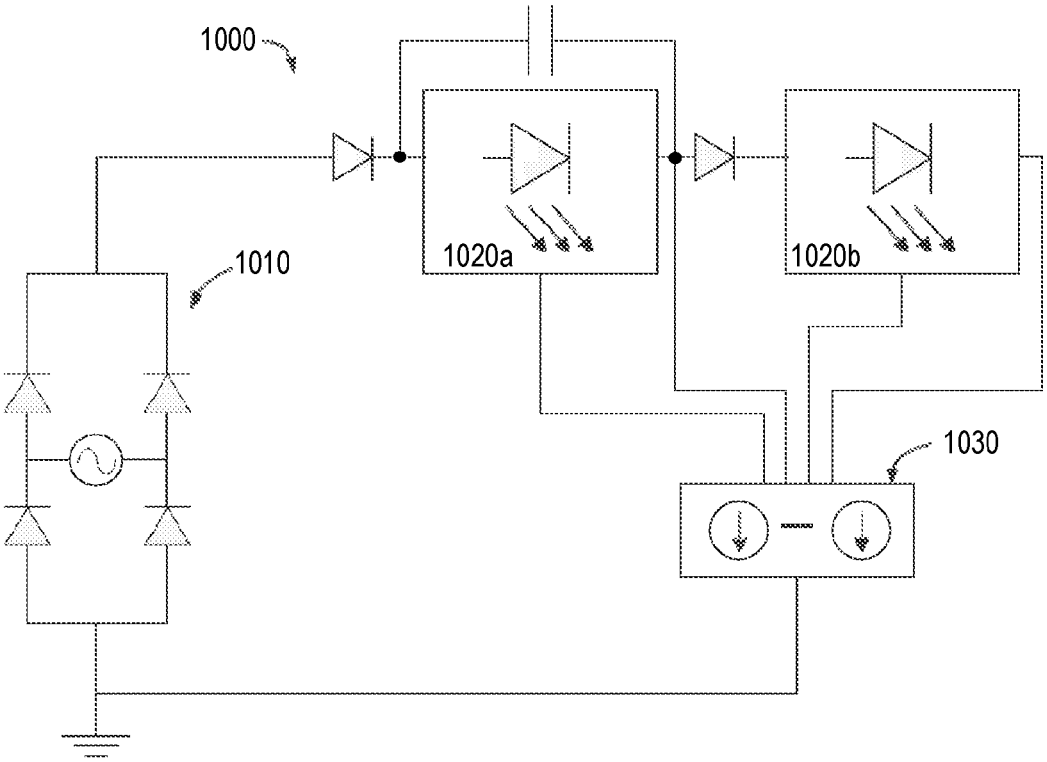
FIG. 10 illustrates an exemplary AC direct step lighting system including a valley fill circuit for each target LED group, according to another embodiment.

FIG. 10 illustrates an exemplary AC direct step lighting system including a valley fill circuit for each target LED group, according to another embodiment. The valley fill circuit is used on the upstream portion of the LED load. In comparison to the AC direct step lighting system 800 wherein each LED group has a valley fill circuit, the AC direct step lighting system 900 and 1000 may target a specific LED group and lower ripple in the target LED group using less elements.

Figure 11:
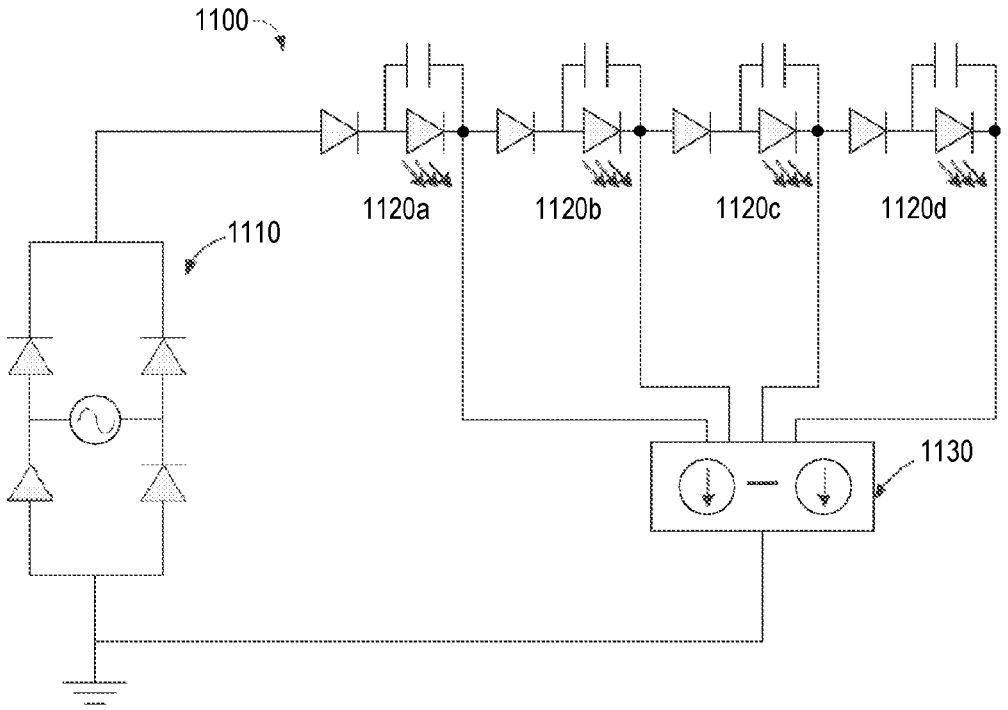
FIG. 11 illustrates an exemplary AC direct step lighting system including a valley fill circuit for each LED group, according to another embodiment.

FIG. 11 illustrates an exemplary AC direct step lighting system including a valley fill circuit for each LED group, according to another embodiment. The AC lighting system 1100 has four valley fill circuits. Each of the valley fill circuits is used across the corresponding target LED group 1120. The valley fill circuit has a diode disposed on the upstream of the corresponding LED group and a capacitor across the corresponding LED group. The diode prevents the stored energy from flowing in the opposite direction and provides energy from the AC voltage source 1110 to the target LED group. The AC direct step lighting system 1100 provides flicker free operation across the LED groups. The sizes (or values) of the energy blocking element (e.g., diode) and the energy storage element (e.g., capacitor) in each valley fill circuit may be determined to provide a desired lighting operation. Flicking may vary depending on various factors, for example, the flicker spec, the LED power supply and the LED power consumption. By changing these values of the diode and capacitor for each target LED group, the AC lighting system 1100 can achieve a desired flicker spec without changing the design of the LED driver 1130.

Figure 12:
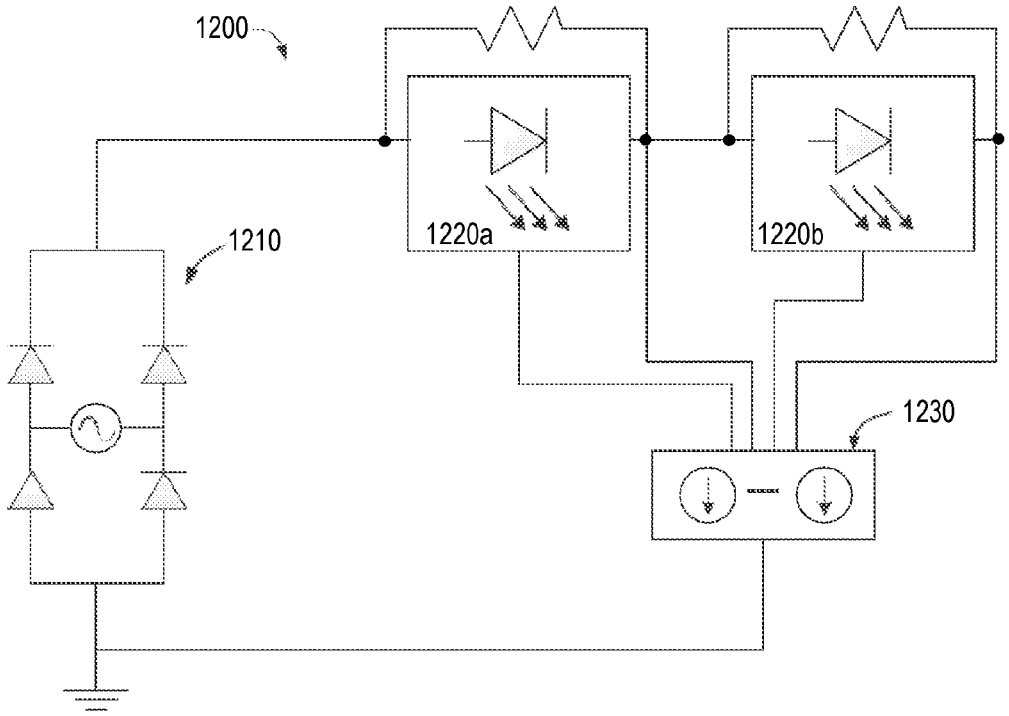
FIG. 12 illustrates an exemplary AC direct step lighting system including a plurality of load balancer circuits for each target LED group, according to one embodiment.

FIG. 12 illustrates an exemplary AC direct step lighting system including a plurality of load balancer circuits for each target LED group, according to one embodiment. The AC lighting system 1200 has two target LED groups 1220*a* and 1220*b*. Each of the target LED groups 1220*a* and 1220*b* is coupled with a corresponding load balancer circuit. A resistor of the load balancer circuit is used as a bleeder. However, it is appreciated that any current flowing circuit can be used, for example, a metal-oxide-semiconductor field-effect transistor (MOSFET). The resistor is disposed in parallel with the target LED group to separately draw current from the target LED group and reduce current flowing into the target LED group.

Figure 13:
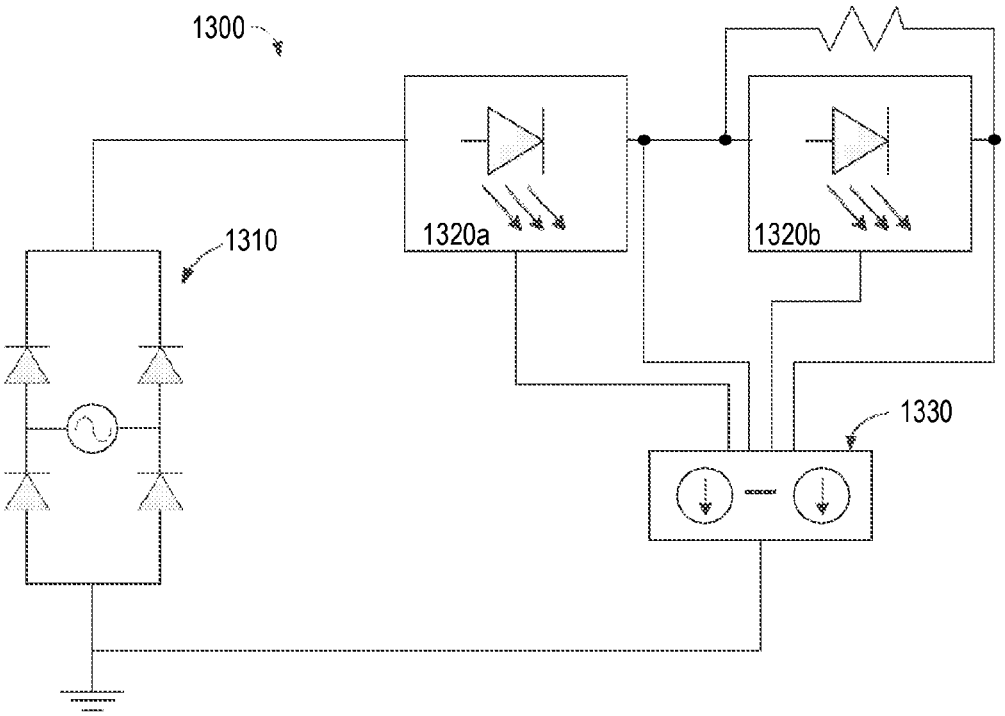
FIG. 13 illustrates an exemplary AC direct step lighting system including a load balancer circuit for a downstream LED group, according to another embodiment.

FIG. 13 illustrates an exemplary AC direct step lighting system including a load balancer circuit for a downstream LED group, according to another embodiment. Resistor is used as a bleeder for a downstream LED group. The AC lighting system 1300 can be used to lower the current in the downstream LED group 1320*b*. After testing luminous flux of the AC lighting system 1300, luminous flux for each LED group can be adjusted individually to achieve a desired light uniformity.

Figure 14:
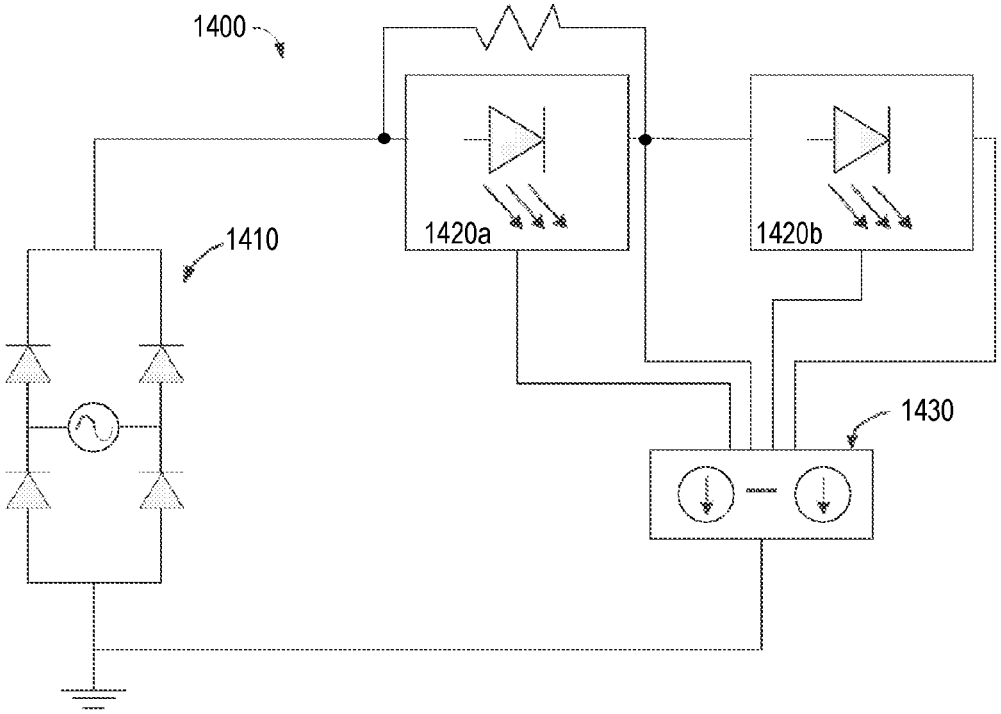
FIG. 14 illustrates an exemplary AC direct step lighting system including a load balancer circuit for an upstream LED group, according to another embodiment.

FIG. 14 illustrates an exemplary AC direct step lighting system including a load balancer circuit for an upstream LED group, according to another embodiment. Resistor is used as a bleeder for an upstream LED group. The AC lighting system 1400 can be used to lower the current in the upstream LED group 1420*a* to match with the light density (or luminous flux) in the downstream LED groups 1420*a* to achieve uniform brightness across the LED groups.

Figure 15:
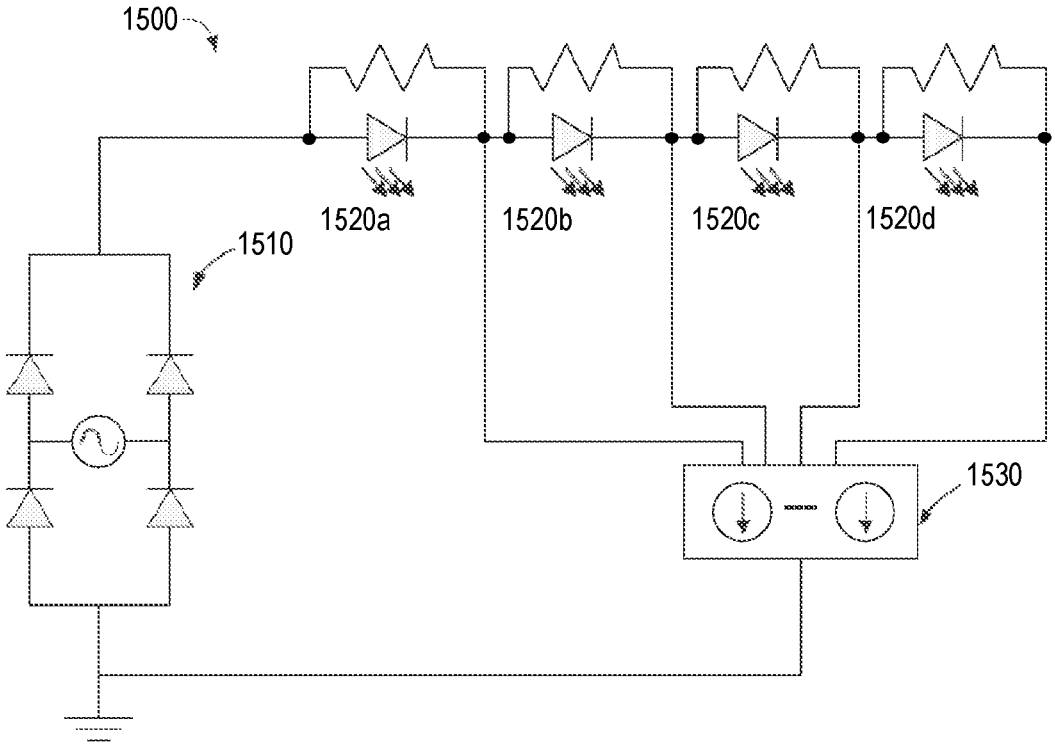
FIG. 15 illustrates an exemplary AC direct step lighting system including a plurality of load balancer circuits for each LED group, according to another embodiment.

FIG. 15 illustrates an exemplary AC direct step lighting system including a plurality of load balancer circuits for each LED group, according to another embodiment. Resistor is used as a bleeder for each LED group. Each bleeder can be sized differently to change the each LED group's current level separately to match each LED group's the light density (or luminous flux) to achieve uniform brightness across the LED groups.

Figure 16:
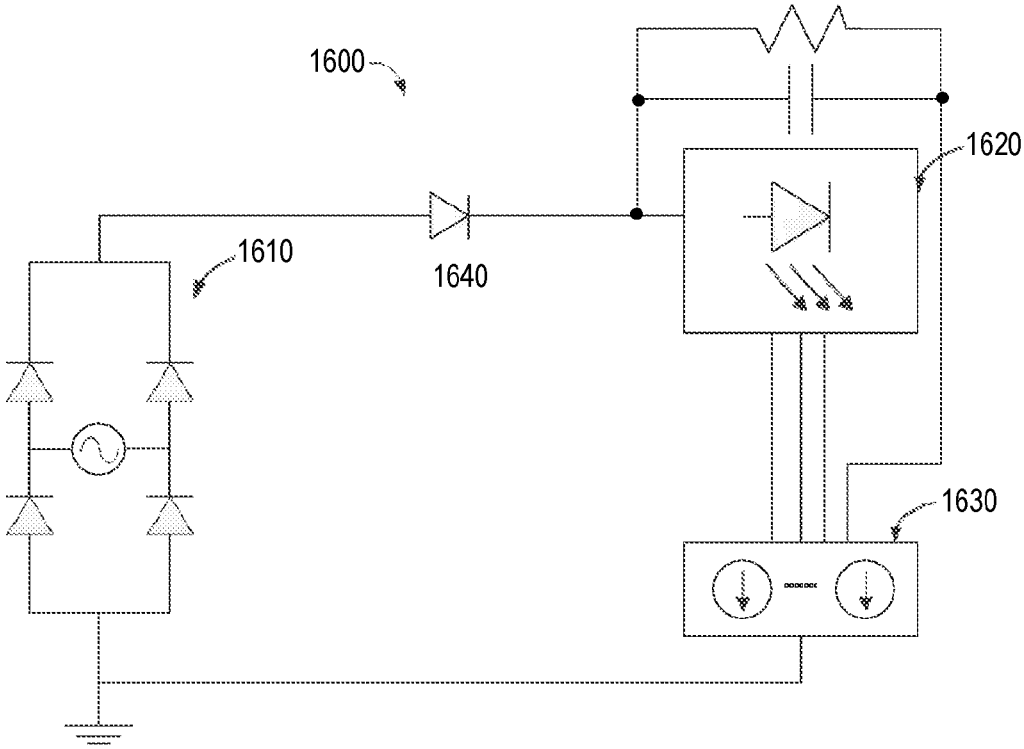
FIG. 16 illustrates an exemplary AC direct step lighting system including a valley fill circuit and a light balancer circuit, according to one embodiment.

FIG. 16 illustrates an exemplary AC direct step lighting system including a valley fill circuit and a light balancer circuit, according to one embodiment. The AC lighting system 1600 has a single valley fill circuit including the diode 1640 and a single load balancer circuit that are connected to the terminal ends of the LED load 1620. The LED load 1620 may contain any number of LED groups in it, and the valley fill circuit and the light balancer circuit controls the current flow across the LED groups.

FIGS. 17-23 illustrate an exemplary AC direct step lighting system including various combinations of a valley fill circuit and a light balancer circuit, according to some embodiments. The valley fill circuit and a load balancer circuit are applied to different LED groups separately.

Figure 17:
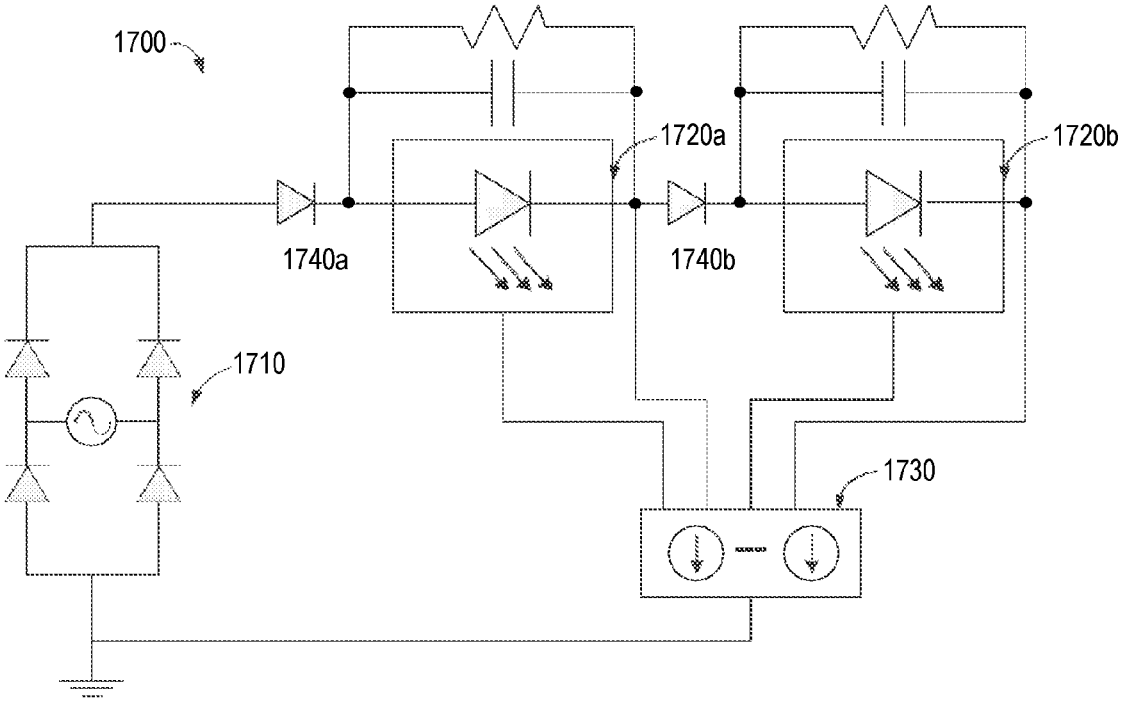
FIGS. 17-23 illustrate an exemplary AC direct step lighting system including various combinations of a valley fill circuit and a light balancer circuit, according to some embodiments.
Figure 18:
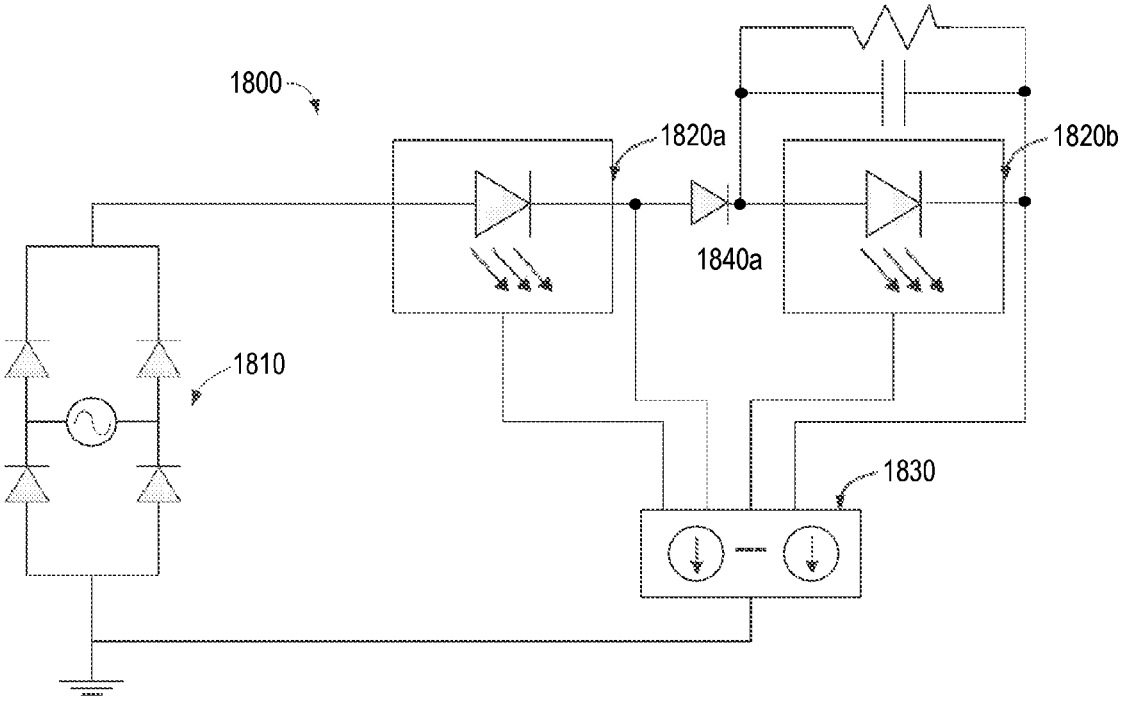
Figure 19:
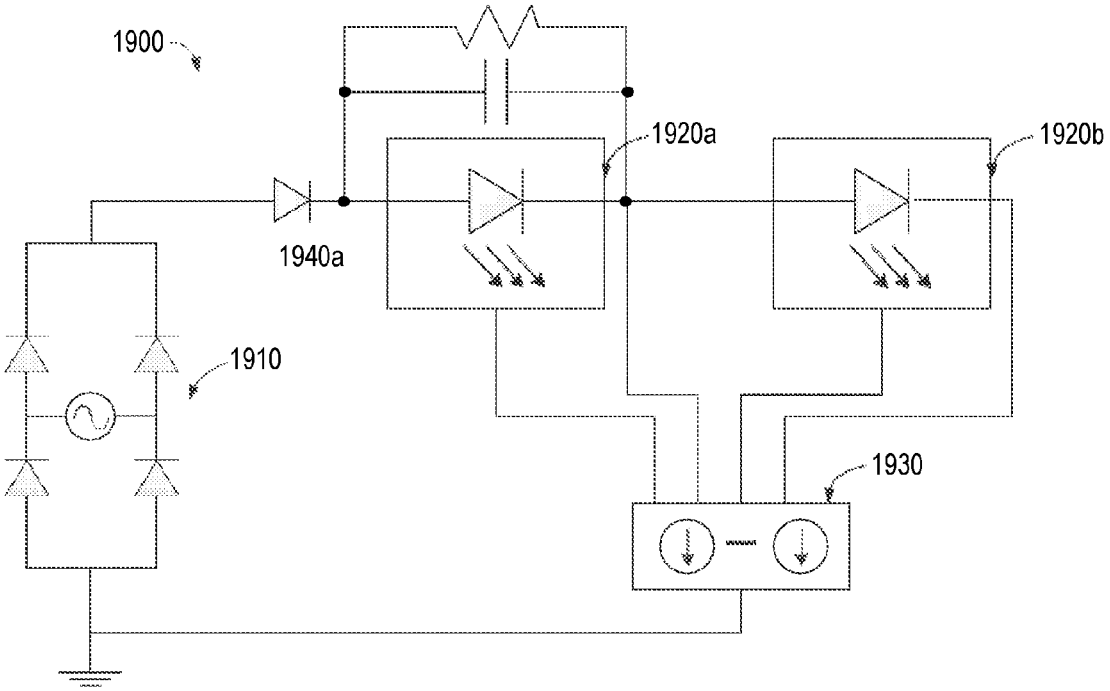
Figure 20:
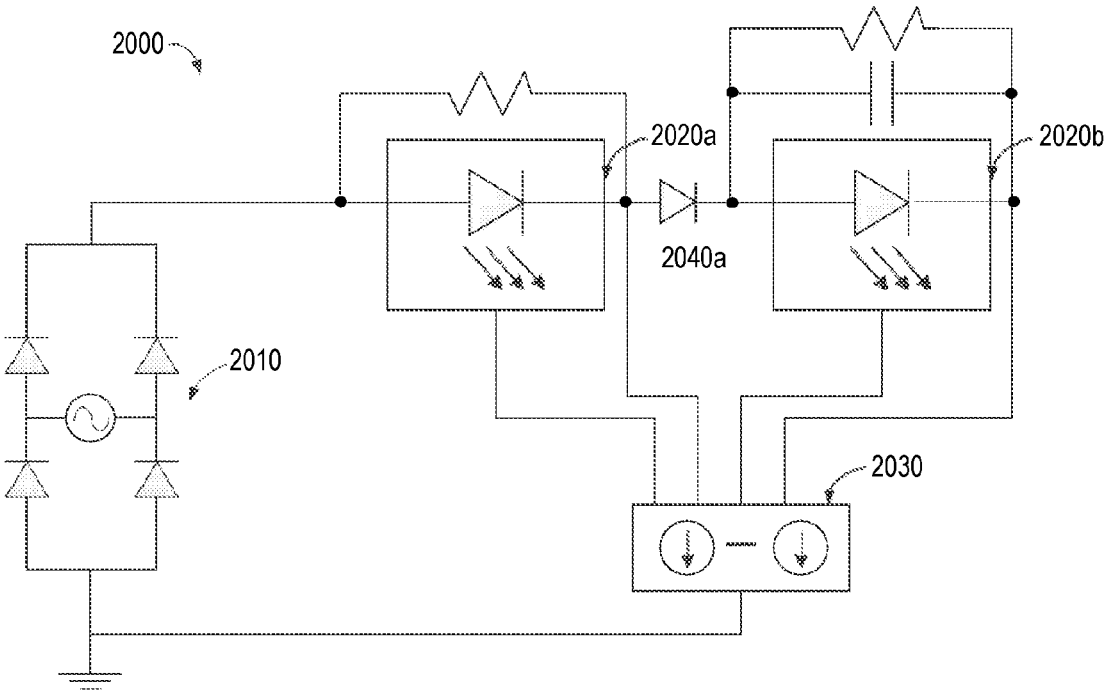
Figure 21:
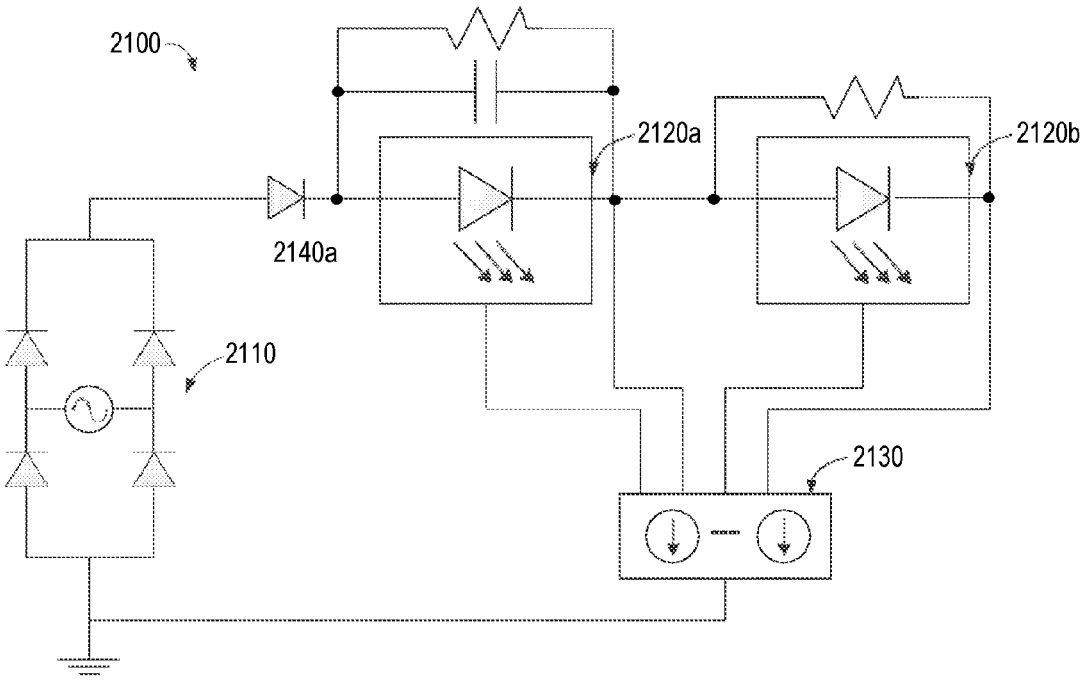
Figure 22:
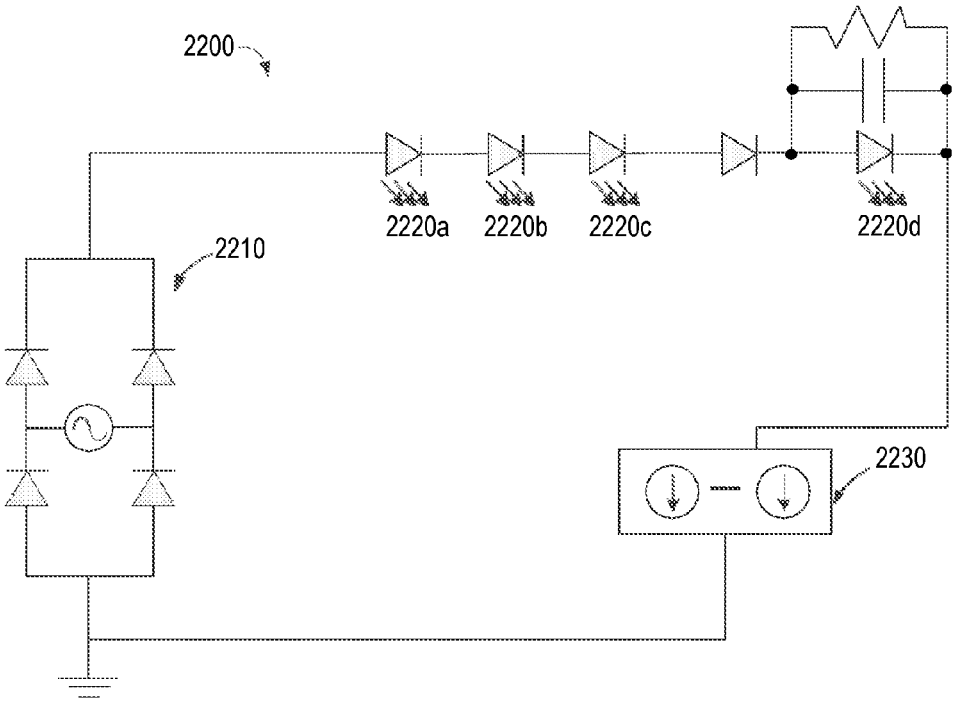
Figure 23:
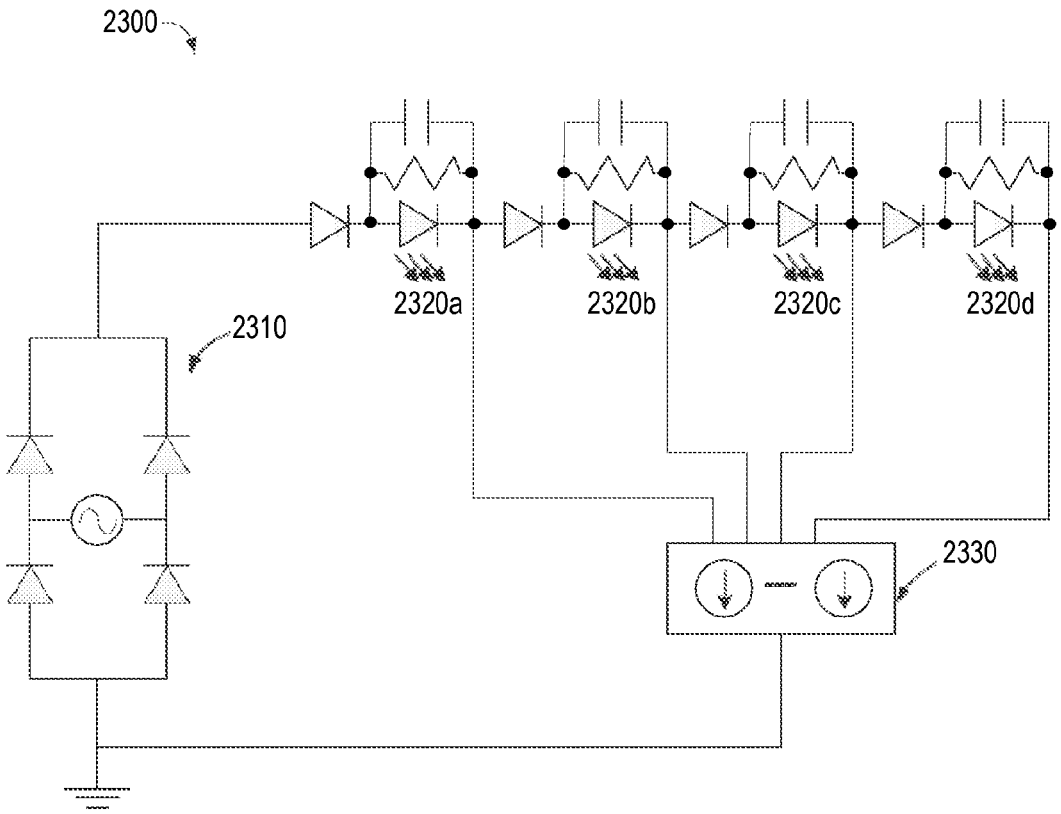

The AC lighting system 1700 of FIG. 17 has two valley fill circuits and light balancer circuits for each of the two LED groups 1720*a* and 1720*b*. The LED groups 1720*a* and 1720*b* may contain several LED groups in them, for example, two LED groups. The AC lighting system 1800 of FIG. 18 has a valley fill circuit and a light balancer circuit for the downstream LED groups 1820*a*. The AC lighting system 1900 of FIG. 19 has a valley fill circuit and a light balancer circuit for the upstream LED groups 1920*a*. The AC lighting system 2000 of FIG. 20 has a load balancer circuit for the upstream LED group 2020*a* and a combination of a valley fill circuit and a light balancer circuit for the downstream LED group 2020*b*. The AC lighting system 2100 of FIG. 21 has a load balancer circuit for the downstream LED group 2120*b* and a combination of a valley fill circuit and a light balancer circuit for the upstream LED group 2120*a*. The AC lighting system 2200 of FIG. 22 has a load balancer circuit and a valley fill circuit only for the downstream LED group 2220*d*. The AC lighting system 2300 of FIG. 23 has a combination of a valley fill circuit a load balancer circuit for each of the LED groups 2320*a*-2320*d*.

Figure 28:
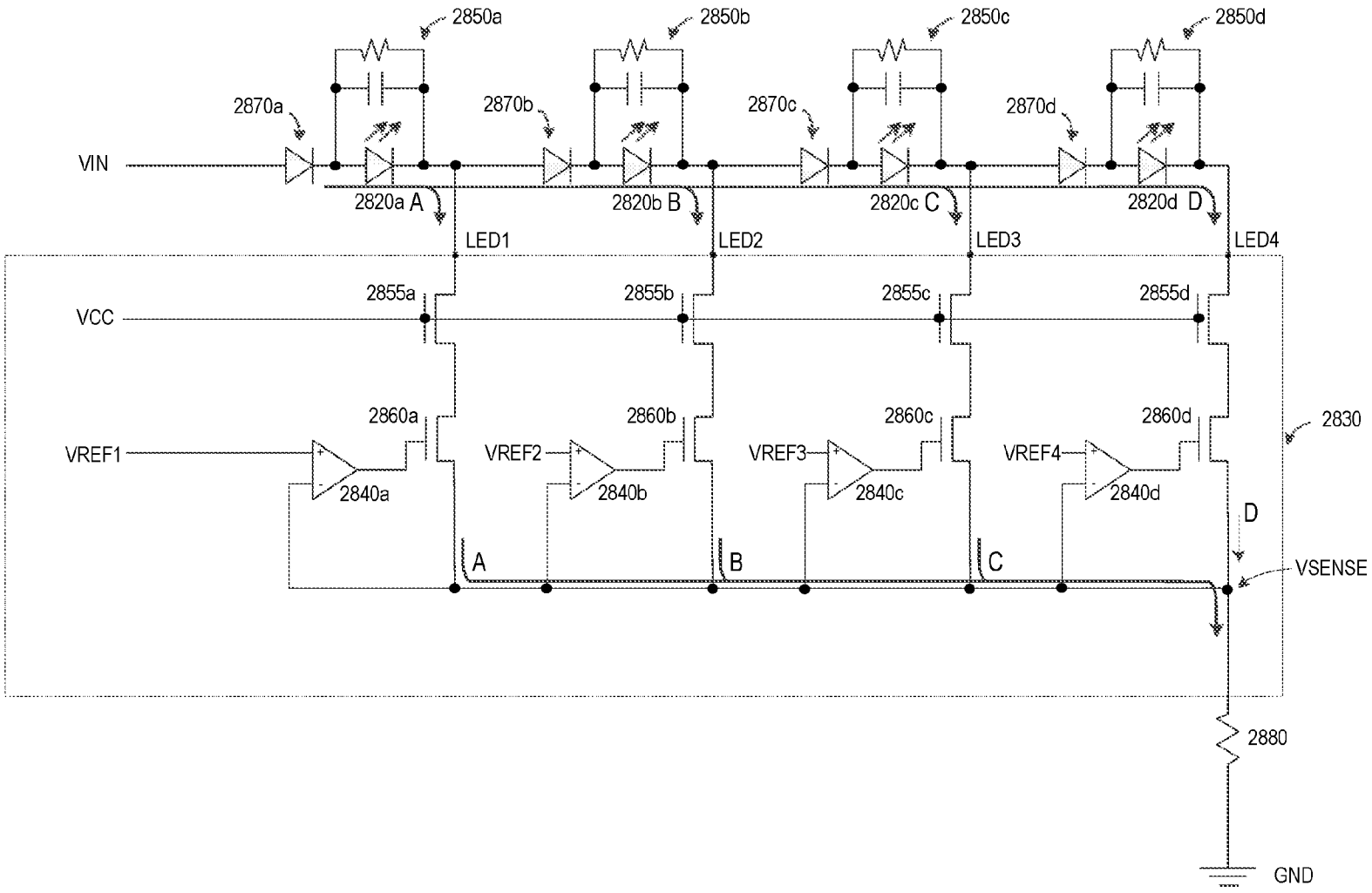
FIG. 28 illustrates a schematic diagram of an exemplary LED driver circuit, according to one embodiment.

FIG. 28 illustrates a schematic diagram of an exemplary LED driver circuit, according to one embodiment. The LED driver 2830 is powered by an alternative current (AC) power source. The electrical voltage from the AC power source is rectified by a rectifier circuit (e.g., a bridge diode rectifier) that is capable of rectifying the alternating voltage from the AC power source. The rectified voltage is applied to a string of light emitting diode (LED) groups 2820*a*-2820*d*. Each LED group may contain one or more LED elements. If desirable, the AC power source and the rectifier may be replaced by a direct current (DC) power source.

According to one embodiment, the string of LED groups is divided into four groups. Each of the LED groups is connected to a diode (e.g., 2870*a*-2870*d*) that is disposed on the upstream and connected to a current regulating circuit (herein also referred to as a cascode circuit) and a sensor amplifier (e.g., 2840*a*-2840*d*) on the downstream. According to one embodiment, the cascode circuit includes a first transistor (e.g., 2855*a*-2855*d*) and a second transistor (e.g., 2860*a*-2860*d*). The current regulating circuits regulate current that flows through one or more of the LED groups. Although the example shown with reference to FIG. 28 includes four LED groups, each of which is coupled to a respective cascode circuit and a sensor amplifier, it should be apparent to those of ordinary skill in the art that the string of LEDs may be divided into any suitable number of LED groups. The LEDs in each group may be a combination of the same or different kind, such as different color. The LEDs can be connected in series or parallel or a mixture of both.

The first transistor (e.g., 2855*a*-2855*d*) and the second transistor (e.g., 2860*a*-2860*d*) of a cascode circuit are connected in series. Hereinafter, the term transistor refers to any type of transistors including, but not limited to, an N-Channel MOSFET, a P-Channel MOSFET, an NPN-bipolar transistor, a PNP-bipolar transistor, an Insulated gate Bipolar Transistor (IGBT), an analog switch, and a relay. The first transistor of the cascode circuit is capable of shielding the second transistor from high voltages or surges. As such, the first transistor is referred as a shielding transistor herein, even though its function is not limited to shielding the second transistor. The main function of the second transistor includes regulating current that passes through the cascode circuit, and as such, the second transistor is referred as a regulating transistor herein. The shielding transistor may be an ultra-high-voltage (UHV) transistor that has a high breakdown voltage of 500 V, for instance, while the regulating transistor may be a low-voltage (LV), medium-voltage (MV), or a high-voltage (HV) transistor and has a lower breakdown voltage than the shielding transistor.

The sensor amplifier (e.g., 2840*a*-2840*d*) compares the voltage VSENSE that is downstream of the cascode circuit with a reference voltage (e.g., Vref1-Vref4), and outputs a control signal that is an input to the gate of the regulating transistor (e.g., 2860*a*-2860*d*). The output signal from the sensor amplifier forms a feedback control of the current flowing through the cascode circuit. In one embodiment, the sensor amplifier 2840*a*-2840*d* is an operational amplifier.

According to one embodiment, the references voltages Vref1, Vref2, Vref3 and Vref4 are set to different values. For instance, the reference voltages may satisfy the condition, Vref1<Vref2<Vref3<Vref4, so that the LED driver 2830 can turn on/off each LED group successively as the level of sensing voltage VSENSE changes. As the input voltage of from the power source starts increasing from zero, the input voltage may not be high enough to flow current through the LED groups in the absence of a valley fill circuit (e.g., 2850*a*-2850*d*) that is connected to each of the LED groups in parallel. Even when the input voltage is lower than the threshold voltage of the LED group, the charged voltage of the valley fill circuit allows current to flow through one or more of the current paths A-D.

When the sensing voltage VSENSE is lower than Vref1, the first sensor amplifier 2840*a* outputs a control signal to the gate of the first regulating circuit 2860*a* rendering the first regulating circuit 2860*a* in a stand by state (SB) to regulate current. As the input voltage from the power source further increases over the threshold voltage of the first LED group 2820*a*, regulated current flows through the current path A across the first regulating circuit 2860*a*. The regulated current that flows through across the first regulating circuit 2860*a* is approximated by VSENSE divided by a current sensing resistor 2880 that is disposed on the downstream of the current paths A-D. At this stage, the sensing voltage VSENSE may be lower than Vref2, Vref3, and Verf4, in which case the sensor amplifiers 2840*b*-2840*d* still output control signals to the gates of the corresponding current regulating circuits 2860*b*-2860*d* rendering the current regulating circuits 2860*b*-2860*d* in a stand-by state to flow current. However, the current paths B, C, and D are blocked until the input voltage to the LED groups 2820*b*-2820*d* increases over the respective threshold voltages to flow current through the current paths B, C, and D. Even when the input voltage is lower than the threshold voltage of the first LED group 2820*a*, a small amount of current may flow through the current path A to charge the capacitor of the valley fill circuit 2850*a* due to the electrical characteristics of the first LED group 2820*a* although the current may not be enough to turn on the first LED group 2820*a*. It is noted that the first current regulating circuit 2860*a* may be turned on before, at, or after the input voltage from the power source and the valley fill circuit 2850*a* reaches a level enough to power the first LED group 2820*a*. The same principle applies to other regulating circuits 2860*b*-2860*d* that correspond to the LED group 2820*b*-2820*d*.

When the regulated current flows through the current path A across the current regulating circuit 2860*a*, the sensor amplifiers 2840*b*-2840*d* also place the corresponding current regulating circuits 2860*b*-2860*d* in a SB state. As the input voltage from the power source further increases over the threshold voltage of the first LED group 2820*a* and the second LED group 2820*b*, regulated current starts to flow through the LED groups 2820*a* and 2820*b* via the current path B across the second current regulating circuit 2860*b*. At this stage, the sensing voltage VSENSE is increased over Vref1 so that the sensor amplifier 2840*a* outputs a low control signal (e.g., 0V) to the gate of the regulating circuit 2860*a* blocking the current path A. As discussed above, the second current regulating circuit 2860*b* may be turned on before, at, or after the input voltage from the power source or the valley fill circuits 2850*a* and/or 2850*b* reaches the level enough to power the first and second LED groups 2820*a* and 2820*b*.

When regulated current flows through the current path B across the second current regulating circuit 2860*b*, the overall efficiency of the driver 2830 would be enhanced if the current path A is cut off or the current that flows through the current path A is regulated. It is because the second LED group 2820*b* would produce more light if more current flows though the current path B than current path A. It would cause the current that would otherwise flow through the current path A to be redirected to the second LED group 2820*b* while both the first and second LED groups 2820*a* and 2820*b* are turned on. As the current flows through the current path B, the sensing voltage VSENSE further increases and exceeds Vref1 at some point in time. At this point, the sensor amplifier 2840*a* outputs a control signal to turn off the gate of the first regulating circuit 2860*a*, reducing or cutting off the current path A while allowing the current to flow through the current path B.

As the sensing voltage VSENSE further increases, the LED current flowing through the current path B further increases, and the current flowing through the current path A is further decreased and finally cut off by the sensor amplifier 2840*a* because the sensing voltage VSENSE becomes higher than Vref1. At this point, current flows through the current path B across the second current regulating circuit 2860*b* turning on both the first and second LED groups 2820*a* and 2820*b*. The current flowing through the current path B is regulated by the sensor amplifier 2840*b*. Even when the input voltage is lower than the threshold voltage of the LED groups 2820*a*-2820*b*, a small amount of current may flow through the current path B to charge the capacitor of the valley fill circuit 2850*b* although the current may not be enough to turn on the second LED group 2820*b*.

As the input voltage further increases over the threshold voltage to flow current through the LED groups 2820*a*-2820*c*, current starts to flow via the current path C. As the sensing voltage VSENSE further increases, the LED current flowing through the current path C further increases, and the current flowing through the current path B is further decreased and finally cut off by the sensor amplifier 2840*b* because the sensing voltage VSENSE becomes higher than Vref2. At this point, current flows through the current path C across the third current regulating circuit 2860*c* turning on the LED groups 2820*a*-2820*c*. The current flowing through the current path C is regulated by the sensor amplifier 2840*c*. Even when the input voltage is lower than the threshold voltage of the LED groups 2820*a*-2820*c*, a small amount of current may flow through the current path C to charge the capacitor of the valley fill circuit 2850*c* although the current may not be enough to turn on the third LED group 2820*c*.

As the input voltage further increases over the threshold voltage to flow current through the LED groups 2820*a*-2820*d*, current starts to flow via the current path D. As the sensing voltage VSENSE further increases, the LED current flowing through the current path D further increases, and the current flowing through the current path C is further decreased and finally cut off by the sensor amplifier 2840*c* because the sensing voltage VSENSE becomes higher than Vref3. At this point, current flows through the current path D across the third current regulating circuit 2860*d* turning on the LED groups 2820*a*-2820*d*. The current flowing through the current path D is regulated by the sensor amplifier 2840*d*. Even when the input voltage is lower than the threshold voltage of the LED groups 2820*a*-2820*d*, a small amount of current may flow through the current path D to charge the capacitor of the valley fill circuit 2850*d* although the current may not be enough to turn on the fourth LED group 2820*d*.

Generally speaking, when a downstream LED group is turned on, and the current regulating circuit associated with the downstream LED group conducts, the current regulating circuit associated with upstream groups remains in a stand-by state (or the current flowing through the regulating circuit is set to a minimal level) using the corresponding sensing amplifier to enhance the overall efficiency of the driver circuit 2830.

According to one embodiment, the valley fill circuit (e.g., 2850*a*-2850*d*) includes a resistor and a capacitor connected in parallel. In some embodiments, the valley fill circuit may be the ones shown in FIGS. 2-4, 6-11, and 16-23 including a various combination of circuits, components, and a load balancer, including, but not limited to, circuits 240, 340, 440, 540, 640, 750, 850, and 950 of FIGS. 2-9.

Figure 29:
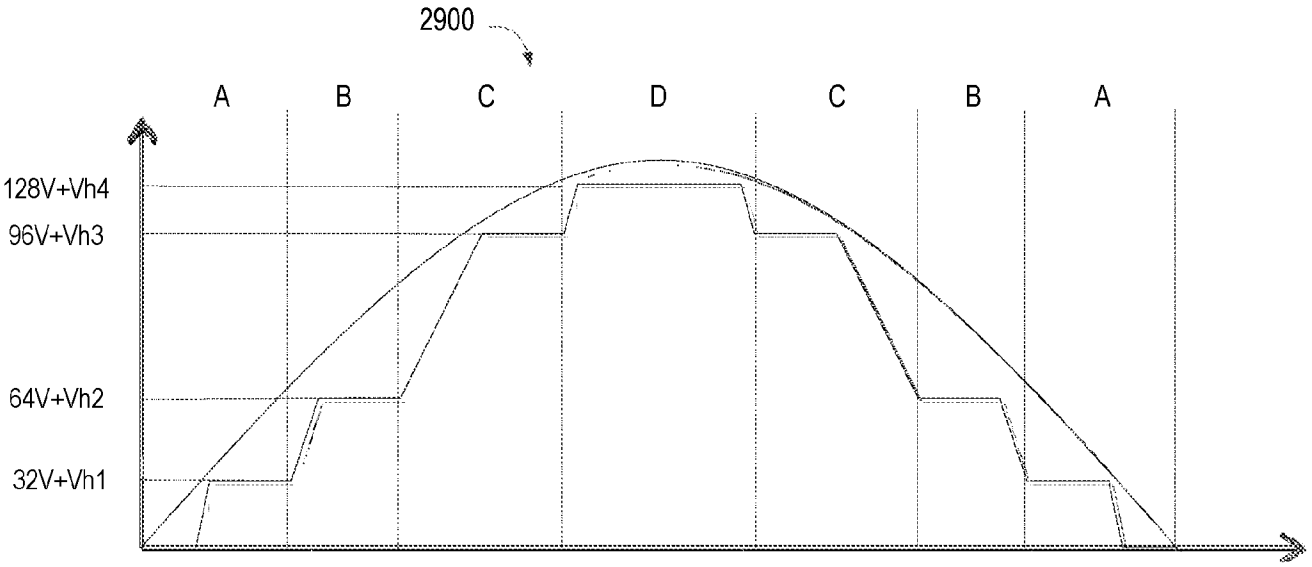
FIG. 29 shows a timing diagram of an exemplary LED system of FIG. 28, according to one embodiment.

FIG. 29 shows a timing diagram of an exemplary LED system of FIG. 28, according to one embodiment. The timing diagram 2900 shows timing of the LED groups 2820*a*-2820*d* with reference to current paths A-D shown in FIG. 28. The threshold voltage of each of the LED groups 2820*a*-2820*d* is assumed to be the same, in this example, 32V. It is noted that other threshold voltages may be used or different threshold voltages for each LED group may be employed without deviating from the scope of the present disclosure. When the voltage input to the LED group 2820*a* (i.e., the combined voltage of the input voltage Vin from the power source and the charge voltage of the valley fill circuit 2850*a*) is below the threshold voltage 32V, the current regulating circuit 2860*a* is in a stand-by state to flow current through the current path A. The actual current that flows through the current path A is determined by the electrical characteristics of the LED group 2820*a*. The diode 2870*a* blocks the current from flowing toward the power source while allowing current to flow from the valley fill circuit 2850*a* to the LED group 2820*a*. When the input voltage is between 32V and 64V, current flows via the current path B and the current path A is cut off, thereby the first and second LED groups 2820*a* and 2820*b* are turned on. When the input voltage is between 64V and 96V, current flows via the current path C and the current paths A and B are cut off, thereby the first, second, and third LED groups 2820*a*, 2820*b*, and 2820*c* are turned on. Similarly, when the input voltage is between 96V and 128V, current flows via the current path D and the current paths A, B, and C are cut off, thereby all of the LED groups 2820*a*-2820*d* are turned on.

The table 2950 shows the states of each of the current sinks of the LED driver 2830 of FIG. 28 during the voltage cycle shown in the exemplary timing diagram 2900. When the input voltage is lower than the threshold voltage 32V, the current sinks LED1-LED4 are in a stand-by (SB) state ready for flowing the current therethrough. As the input voltage from the power source increases, the first sensor amplifier 2840*a* turns on the gate of the first regulating circuit 2860*a*, rendering the first current sink LED1 regulates current flowing through the current path A while leaving the LED sinks LED2-LED4 in a SB state. The input voltage further increases, the current sink LED2 regulates the current to flow through the current path B, turning off (or reducing current flowing through) the current path A while leaving the LED sinks LED3-LED4 in a SB state. The input voltage further increases, the current sink LED3 regulates the current flowing through the current path C, turning off (or reducing current flowing through) the current paths A and B while leaving the LED sink LED4 in a SB state. The input voltage further increases, the current sink LED4 regulates current flowing through the current path D, turning off (or reducing current flowing through) the current paths A, B, and C. The states of the current sinks LED1-LED4 reverse as the input voltage decreases.

The valley fill circuits 2850*a*-2850*d* shown in FIG. 28 are distinct from conventional valley fill circuits in several respects. First, the valley fill circuit is connected to a current regulating circuit to allow current to flow across the coupled LED group even when the input voltage is lower than a threshold voltage of the LED group, thus reducing or eliminating flicking. Second, the energy storage element (e.g., capacitor) of the valley fill circuit is charged even when the threshold voltage is below the threshold voltage of the LED group, and even when the current regulating circuit is open and no current flows through the current regulating circuit. The current sink, in this case, is in a stand-by state ready for flowing current when the input voltage is high enough to power the LED group(s). For example, when the input voltage is below 32V, which is the threshold voltage of the LED group 2820*a*, the sensor amplifiers 2840*a*-02840*d* output a control signal to the gate of the corresponding current regulating circuits 2860*a*-2860*d* rendering the current regulating circuits 2860*a*-2860*d* in a stand-by state to flow current. In practice, after the LED driver 2830 is turned on, the valley fill circuits 2850*a*-2850*d* are charged up, therefore the voltage at the downstream of the current regulating circuits 2860*a*-2860*d* (i.e., VSENSE) may remain above the threshold voltage 32V. In this case, current flows through the current path A even if the input voltage is lower than 32V. At this stage, the valley fill circuit 2850*a* may power the LED group 2820*a*, or the input voltage charges the valley fill circuit 2850*a* as well as powers the LED group 2820*a*. Similarly, the valley fill circuits 2850*b*-2850*d* are charged even when the input voltage is lower than a threshold voltage of the LED groups and/or the current regulating circuits 2860*a*-2860*d* are turned on or off.

Figure 24:
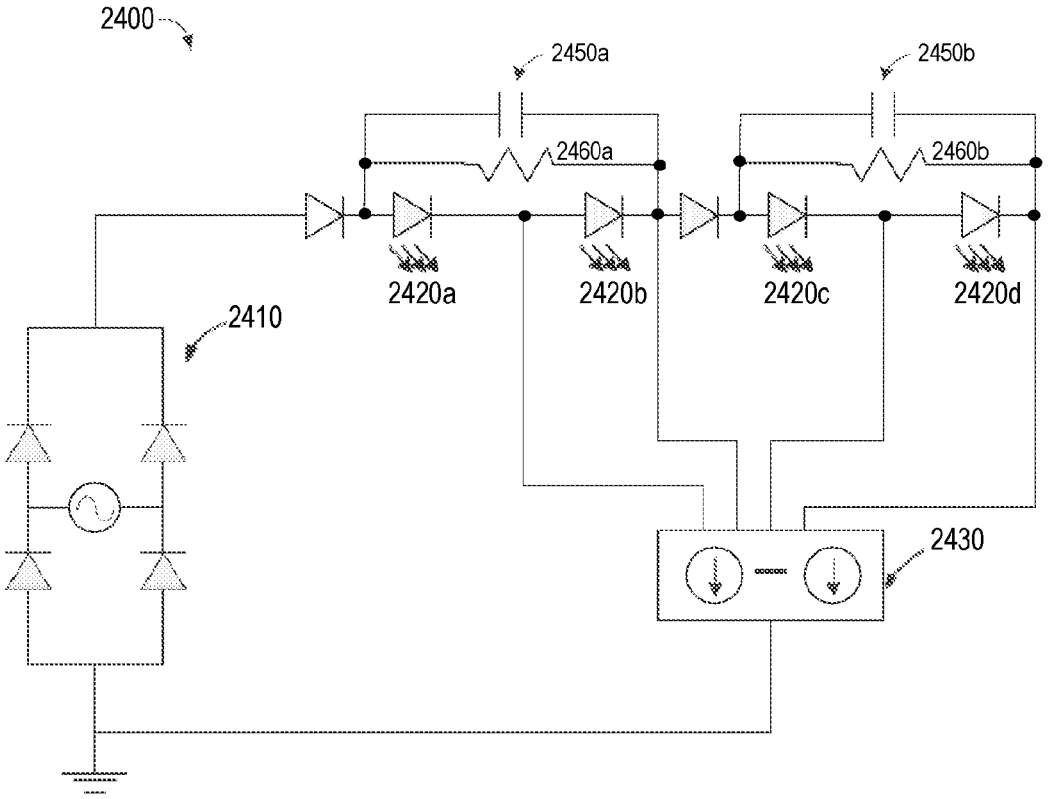
FIG. 24-27 illustrate an exemplary AC direct step lighting system including various configurations of valley fill circuits and load balancer circuits, according to some embodiments.

FIG. 24-27 illustrate an exemplary AC direct step lighting system including various configurations of valley fill circuits and load balancer circuits, according to some embodiments. FIG. 24 illustrates a valley fill circuit that is coupled to two LED groups that are connected in series. For example, the valley fill circuit 2450*a* is coupled to the LED groups 2420*a* and 2420*b*. Similarly, the valley fill circuit 2450*b* is coupled to the LED groups 2420*c* and 2420*d*. Optionally, the valley fill circuits 2450*a* and 2450*b* may be parallel connected with load balance circuits 2460*a* and 2460*b*. Compared to the configuration shown in FIGS. 23 and 28, less number of circuit components is used while reducing the flickering of the LED groups. Since the valley fill circuit and the load balancer circuit are coupled with two LED groups, the charge capacity of the valley fill circuits may be different from the charge capacity of the capacitors of the examples shown in FIGS. 23 and 28 that are connected to a single LED group. In one embodiment, one valley fill circuit (and the load balancer circuit) may be used instead for either the upstream LED groups 2420*a* and 2420*b*, or the downstream LED groups 2420*c* and 2420*d*.

Figure 25:
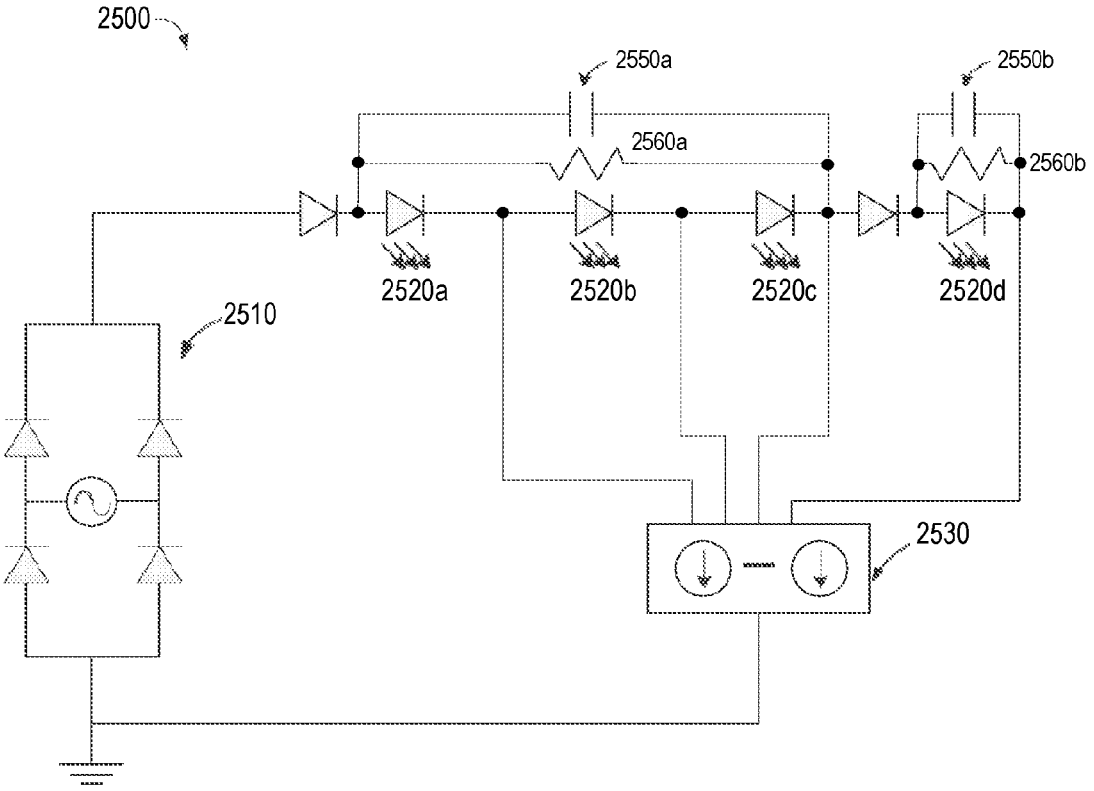

FIG. 25 illustrates a valley fill circuit 2550*a* that is coupled to three LED groups 2520*a*, 2520*b*, and 2520*c* and a valley fill circuit 2550*b* that is coupled to the LED group 2520*d*. In another embodiment, a first valley fill circuit is coupled to the first LED group 2520*d*, and a second valley fill circuit is coupled to the other three LED groups 2520*a*, 2520*b*, and 2520*c*. In yet another embodiment, only one valley fill circuit 2550*a* or 2550*b* may be used instead of using both of the valley fill circuits 2550*a* and 2550*b*. Optionally, the valley fill circuits 2550*a* and 2550*b* may be parallel connected with load balance circuits 2560*a* and 2560*b*.

Figure 26:
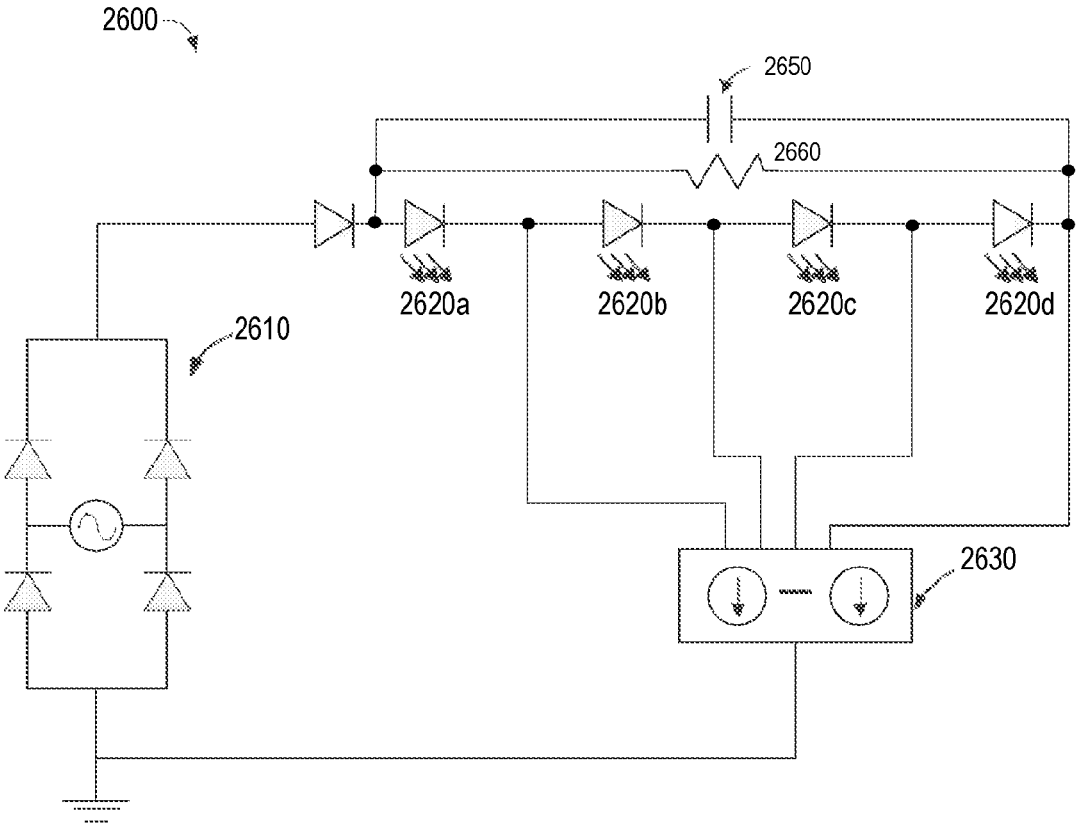

FIG. 26 illustrates a valley fill circuit 2650 that is coupled to all of the four LED groups 2620*a*, 2620*b*, 2620*c*, and 2620*d*. The energy-storing element (e.g., capacitor) of the valley fill circuit 2650 is charged from the voltage input and establishes at least one current path even when the input voltage is lower than the threshold voltage of the LED groups 2620*a*-2620*d*, thereby reducing or minimizing flickering. Optionally, the valley fill circuit 2650 may be parallel connected with a load balance circuit 2660.

Figure 27:
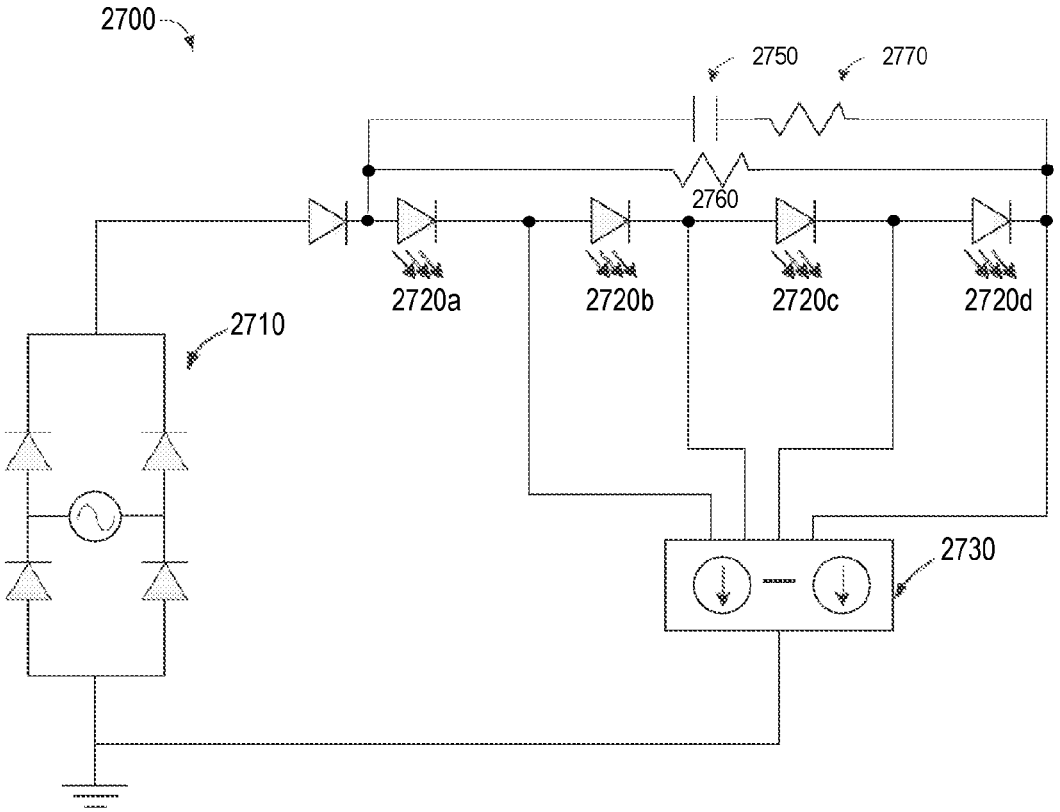

FIG. 27 illustrates a valley fill circuit, according to another embodiment. The valley fill circuit 2750 is connected with a resistor 2770 in series, and a load balancer circuit 2760 in parallel. The valley fill circuits shown in other examples, including but not limited to the examples shown in FIGS. 24-26 and 28, may be connected with a resistor in series such as the resistor 2770 without deviating from the scope of the present disclosure.

The present disclosure describes an AC direct drive lighting system including a valley fill circuit and a light balancer circuit to provide uniform light distribution and minimize flickering. According to some embodiments, the valley fill circuit includes an energy storage element (e.g., capacitor) and an energy-blocking element (e.g., diode). The valley fill circuit may be coupled to an individual LED group of an LED load. According to one embodiment, the light balancer includes a bleeder that is applied to an individual LED group. The valley fill circuit and the light balancer circuit may be combined together and used in different LED group separately. The valley fill circuit and the light balancer circuit do not need a dedicated control and are self-controlled by selecting capacitor and resistance values for the components used in each circuit.

The above exemplary embodiments illustrate various embodiments of implementing an AC lighting system including a valley fill circuit and/or a light balancer circuit for providing uniform light distribution. Various modifications and departures from the disclosed example embodiments will occur to those having ordinary skill in the art. The subject matter that is intended to be within the scope of the invention is set forth in the following claims.

We claim:

1. An alternating current (AC) lighting system comprising:

a plurality of LED groups serially connected to an AC power source;

an AC driver comprising a plurality of current sinks, wherein each of the plurality of current sinks is connected between a respective LED group of the plurality of LED groups and a ground; and at least one valley fill circuit coupled to a target LED group of the plurality of LED groups, wherein the valley fill circuit charges from the AC power source and supplies electrical power to the target LED group via a current path established between the AC power source and the ground via at least one of the plurality of current sinks, wherein each of the plurality of current sinks includes a cascode circuit comprising a first transistor and a second transistor connected in series, wherein the first transistor is provided with a fixed voltage and the second transistor is controlled by a sensor amplifier that compares a reference voltage level and a voltage level at a downstream of the cascode circuit, and wherein a first reference voltage level applied to an upstream sensor amplifier of the plurality of current sinks is lower than a second reference voltage level applied to a downstream sensor amplifier of the plurality of current sinks.

2. The AC lighting system of claim 1, wherein second transistors of each of the plurality of current sinks are commonly connected.

3. The AC lighting system of claim 1, wherein the at least one valley fill circuit comprises a capacitor and a first resistor connected in parallel.

4. The AC lighting system of claim 3, wherein the at least one valley fill circuit further comprises a second resistor serially connected to the capacitor.

5. The AC lighting system of claim 1, wherein the plurality of LED groups includes a first LED group, a second LED group, a third LED group, and a fourth LED group connected in series.

6. The AC lighting system of claim 5, wherein the at least one valley fill circuit includes four valley fill circuits connected to each of the plurality of LED groups in parallel.

7. The AC lighting system of claim 5, wherein the at least one valley fill circuit includes a first valley fill circuit and a second valley fill circuit.

8. The AC lighting system of claim 7, wherein the first valley fill circuit is connected to the first LED group and the second LED group, and wherein the second valley fill circuit is connected to the third LED group and the fourth LED group.

9. The AC lighting system of claim 7, wherein the first valley fill circuit is connected to the first LED group, the second LED group, and the third LED group, and wherein the second valley fill circuit is connected to the fourth LED group.

10. The AC lighting system of claim 5, wherein the at least one valley fill circuit is connected to the plurality of LED groups.

11. The AC lighting system of claim 1, wherein the at least one valley fill circuit includes an energy storage element, and wherein the energy storage element is charged irrespective of a voltage level of the AC power source.

12. The AC lighting system of claim 11, wherein at least one current path is established between the AC power source and the ground via at least one of the plurality of current sinks.

13. A method for reducing flicking of an AC lighting system, the method comprising:

providing an LED driver that is configured to control an LED current flowing through a plurality of LED groups using a plurality of current sinks;

coupling at least one valley fill circuit to a target LED group of the plurality of LED groups;

charging the at least one valley fill circuit from an AC power source; and providing electrical power to a target LED group via a current path established between the AC power source and a ground via at least one of the plurality of current sinks, wherein each of the plurality of current sinks includes a cascode circuit comprising a first transistor and a second transistor connected in series, wherein the first transistor is provided with a fixed voltage and the second transistor is controlled by a sensor amplifier that compares a reference voltage level and a voltage level at a downstream of the cascode circuit, and wherein a first reference voltage level applied to a downstream sensor amplifier of the plurality of current sinks is lower than a second reference voltage level applied to an upstream sensor amplifier of the plurality of current sinks.

14. The method of claim 13, wherein second transistors of each of the plurality of current sinks are commonly connected.

15. The method of claim 13, wherein the at least one valley fill circuit comprises a capacitor and a resistor connected in parallel.

16. The method of claim 13, wherein the plurality of LED groups includes a first LED group, a second LED group, a third LED group, and a fourth LED group connected in series, and wherein the at least one valley fill circuit is connected to a first LED subgroup of the plurality of LED groups including at least one of the first LED group, the second LED group, the third LED group, and the fourth LED group, and a second LED subgroup of the plurality of LED groups including LED groups that are not included in the first LED subgroup.

17. The method of claim 13, further comprising charging an energy storage element of the at least one valley fill circuit irrespective of a voltage level of the AC power source.

* * * * *